US006006984A

United States Patent [19]

Chung et al.

[11] Patent Number: 6,006,984

[45] Date of Patent: Dec. 28, 1999

[54] PAPERBOARD PACKAGE

[76] Inventors: Yun H. Chung, 3010 Hasty Rd., Toledo, Ohio 43615; Dennis E. Chung, 6080 Clark Rd., Ottawa Lake, Mich. 49276

[21] Appl. No.: 08/987,540

[22] Filed: Dec. 9, 1997

Related U.S. Application Data

[62] Division of application No. 08/359,698, Dec. 20, 1994, Pat. No. 5,694,746.

[51] Int. Cl.[6] ..... B65O 5/54

[52] U.S. Cl. ..... 229/137; 229/123.1; 229/123.2; 229/125.15; 229/198.2

[58] Field of Search ..... 229/123.1, 123.2, 229/125.15, 125.33, 125.35, 137, 193, 198.2, 208, 212, 5.84

[56] References Cited

U.S. PATENT DOCUMENTS

| | | | |
|---|---|---|---|
| 3,067,923 | 12/1962 | Thiets | 229/137 |
| 3,797,726 | 3/1974 | Reil | 229/137 |
| 3,908,888 | 9/1975 | Gordon | 229/5.84 |
| 4,813,545 | 3/1989 | Chung et al. | 229/212 |
| 4,815,655 | 3/1989 | Jacobsson et al. | 229/125.15 |
| 4,909,434 | 3/1990 | Jones et al. | 229/125.15 |
| 4,981,257 | 1/1991 | Radbruch | 229/198.2 |
| 5,011,722 | 4/1991 | Chung et al. | 229/208 |

*Primary Examiner*—Gary E. Elkins
*Attorney, Agent, or Firm*—MacMillan, Sobanski & Todd, LLC

[57] ABSTRACT

A single generally rectangular blank which can be formed into a paperboard package. The four corners of the blank are trihedral. The blank is center folded. The width of a first portion of the blank, measured parallel to the centerfold, is greater than a second portion of the blank. The blank is sealed on the two sides adjacent the centerfold to form an open package, which is then filled. The side opposite the centerfold is then sealed to close the package, forming a parallelepiped container. The seals are fin seals. The fin seal opposite the centerfold of the blank overlaps the two seals adjacent the centerfold. The three fin seals are folded flat against the sides of the package. The package may be provided with an opening through the blank. A tab may be provided to completely cover and seal around the opening in the package. The tab includes a grip portion which, when pulled upwardly, lifts the tab away from around the opening in the package. As the tab is pulled upwardly, an outer laminate layer tears away from an inner paper core of the package in the region of the seal between the tab and the package, uncovering the opening in the package. The tab will remain hingedly connected to the package along a rear tongue portion.

12 Claims, 15 Drawing Sheets

FIG. 9
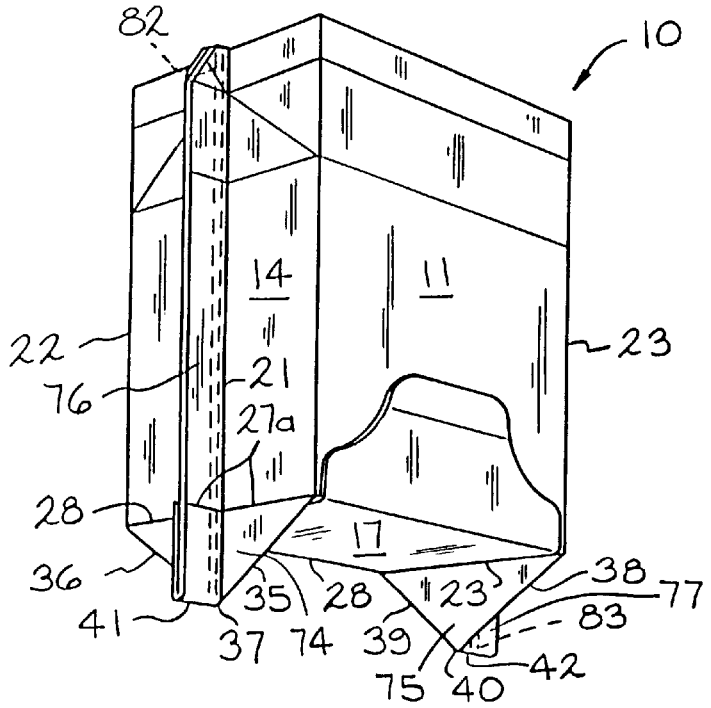
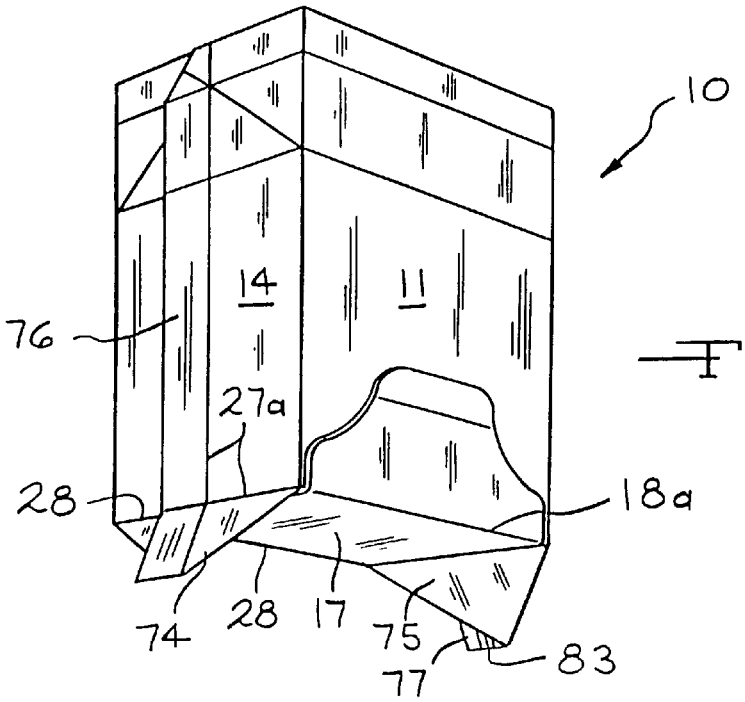
FIG. 10

PAPERBOARD PACKAGE

CROSS-REFERENCE TO RELATED APPLICATIONS

This application is a divisional of U.S. patent application Ser. No. 08/359,698 filed Dec. 20, 1994, now U.S. Pat. No. 5,694,746.

BACKGROUND OF THE INVENTION

This invention relates in general to a rectangular package which is formed from a blank and, in particular, to a blank of paperboard material which is capable of being formed into a package which is capable of holding a liquid, semi-solid, or solid product and may be provided with a separate opening tab for enabling the top portion of the package to be completely opened. The invention also concerns a particular method of making the package.

Paperboard materials are becoming increasingly popular as a packaging material, especially in the food industry. A sheet of paperboard material used to form a package typically includes a main structural layer of paper to provide strength and rigidity to the associated package. In some instances, a layer of aluminum foil can be adhered to one surface of the paperboard to serve as a barrier layer against the passage of contaminants into the package.

Generally, both surfaces of the paperboard are then coated with a heat sealable thermoplastic material. While a number of specific constructions are known, it is generally accepted practice to fold a precut and pre-scored blank of paperboard material into a predetermined configuration, and to apply pressure and heat to certain contacting surfaces of the folded blank to form a package.

Many types of paperboard packages capable of holding a liquid and provided with some type of opening have been proposed. Examples of such packages are disclosed in U.S. Pat. Nos. 3,347,444; 4,317,518; 4,520,929, and U.S. Pat. No. 4,546,884, and in U.S. Pat. No. 5,250,018, which is assigned to the assignee of this application, which are incorporated herein by reference thereto. While the packages disclosed in these patents have been found to be satisfactory for certain packaging applications, there continues to be a need in the industry for a variety of rectangular paperboard packages which are capable of being hermetically sealed and which can be produced economically.

SUMMARY OF THE INVENTION

This invention relates to a laminated paperboard blank and a method of forming the blank into a rectangular paperboard package. The package can be utilized to package a wide variety of products including liquid drinks, frozen concentrated drinks, motor oil, granular or pulverized material, and as a tamper-resistant over-pack for containers which have been previously been filled with a product. The package is constructed from the blank by a unique method. Further, the package may be provided with a unique, pull-away top portion which includes a separate tab member which is fastened to the top panel of the package during the construction thereof and enables the top portion of the package to be completely and easily opened.

More specifically, the package may be constructed from a single generally rectangular blank. The four corners of the blank are trihedral. The blank is center folded. Preferably, the width of a first portion of the blank, measured parallel to the centerfold, is greater than a second portion of the blank. The blank is sealed on the two sides adjacent the centerfold to form an open package, which is then filled. The side opposite the centerfold is then sealed, forming an enclosed parallelepiped container. The seals are fin seals. The fin seal opposite the centerfold of the blank overlaps the two seals adjacent the centerfold. The three fin seals are folded flat against the sides of the package. The package may be provided with an opening through the blank. A tab may be provided to completely cover and seal around the opening in the package. The tab includes a grip portion which, when pulled upwardly, lifts the tab away from around the opening in the package. As the tab is pulled upwardly, an outer laminate layer tears away from an inner paper core of the package in the region of the seal between the tab and the package, uncovering the opening in the package. The tab will remain hingedly connected to the package along a rear tongue portion of the blank.

Various objects and advantages of this invention will become apparent to those skilled in the art from the following detailed description of the preferred embodiment, when read in light of the accompanying drawings.

BRIEF DESCRIPTION OF THE DRAWINGS

FIG. 9 is a bottom perspective view of the package following the forming steps illustrated in FIGS. 7, 8A and 8B.

FIG. 10 is a bottom perspective view which shows the blank following a subsequent fabrication step in which the side fin seals are folded against the side panels, and ear portions extending from the side fin seals are pre-broken outwardly.

DETAILED DESCRIPTION OF THE PREFERRED EMBODIMENT

Preliminarily, it should be noted that the package of the present invention can be fabricated from a variety of commercially available materials. Such materials include multiple layers, of which the center-most is typically one or two layers of paper or paperboard. The paper layer can be covered on one or two sides by a thermoplastic material, such as, for example, polyethylene. In instances wherein it is desirable to reduce gas permeation and/or to provide light blocking or acid resistance, an aluminum foil layer may be added and an additional layer of plastic used to bond the foil layer to the paper layer. Alternatively, a high barrier plastic, resistant to chemical attack, could be used in place of a foil plastic laminate. Laminated material suitable for producing the package of the present invention is available from Champion International Corp. of Stamford, Conn.

It should also be noted that certain terms used herein, such as "front", "back", "side", "top", and "bottom", are used to facilitate the description of the preferred embodiment of the invention, and are not intended as a limitation on the position the package may be in at any stage of its fabrication or handling, either before or after being filled with a product. Such terms should also not be considered as limitations regarding the possibility of modifications such as mirror-image fabrication of the package.

Figure 1:
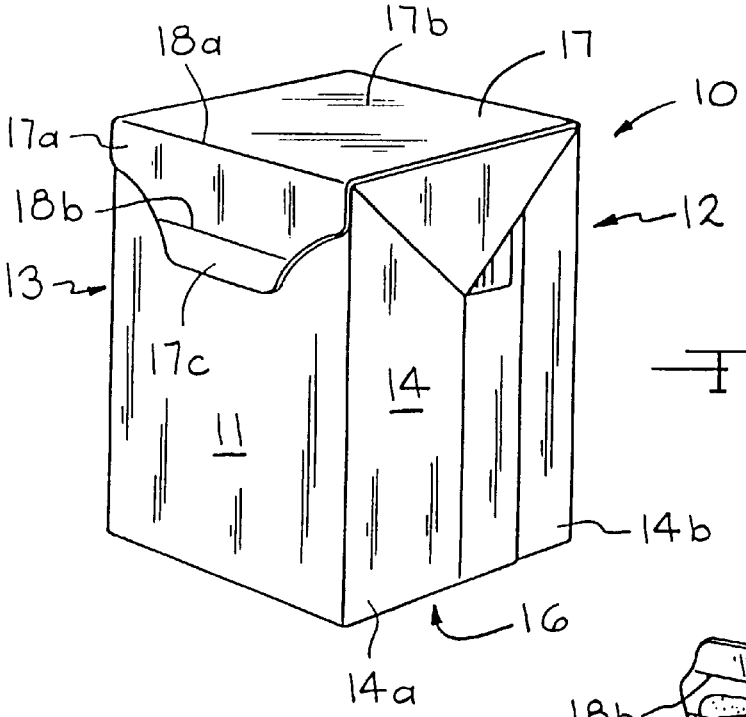
FIG. 1 is a top perspective view which shows a paperboard package according to the preferred embodiment of the invention in an upright position.
Figure 2:
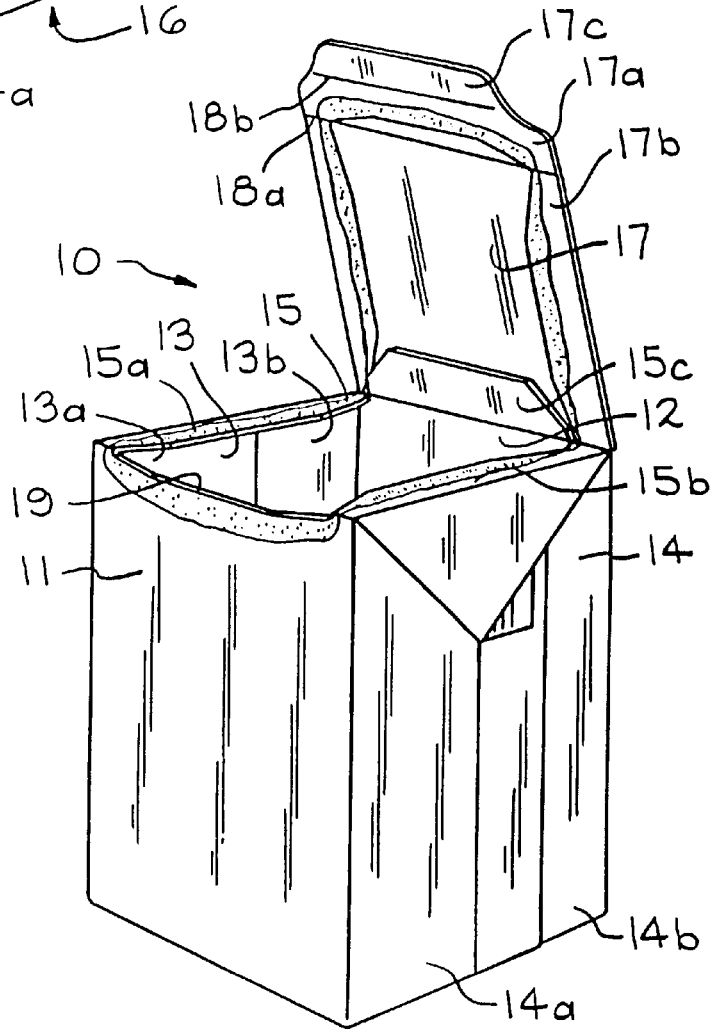
FIG. 2 is a top perspective view which shows the package of FIG. 1 after an opening tab has been pulled upwardly to open the top panel.
Figure 15:
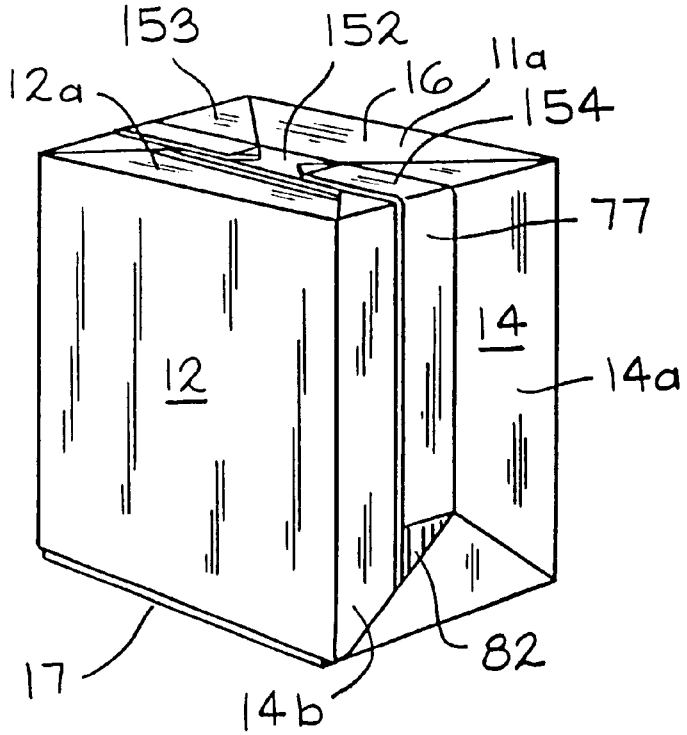
FIG. 15 is a view similar to FIG. 14 illustrating the final folding step in the assembly of the package wherein the upwardly extending bottom seal of FIG. 14 is folded downwardly and the bottom ears are then folded inwardly against the bottom of the package.

Before discussing the details of the blank of the present invention, and the particular method of fabrication of the blank into a package, a brief description of the completed package will be presented. FIG. 1 illustrates a top perspective view of a package 10 according to the invention which is unopened, while FIG. 2 illustrates the package 10 with an opened top portion. A bottom perspective view of the completed package 10 is shown in FIG. 15. The package 10 includes a front panel 11, a back panel 12, a first side panel 13, a second side panel 14, a top panel 15 and a bottom panel 16 (the back panel 12 and the bottom panel 16 are best shown in FIG. 15). The top panel 15 includes two arcuately-shaped side tongue portions 15*a* and 15*b*, and an arcuately-shaped rear tongue portion 15*c*, each of which will be further described below. The two side tongue portions 15*a* and 15*b* form opposed side portions of the upper panel 15.

In FIG. 1, the top panel 15 and the upper portion of the front panel 11 are covered by a separate opening tab 17. The tab 17 has a front portion 17*a* secured to the upper portion of the front panel 11, and a rectangular top portion 17*b* secured to and substantially covering the entire top panel 15. A fold line 18*a* is formed on the tab 17 between the front portion 17*a* and the top portion 17*b* of the tab 17. The tab 17 also includes a grip portion 17*c* hingedly connected to the front portion 17*a* of the tab 17 along a fold line 18*b* but unattached to the front panel 11.

The top panel 15 and the upper portion of the front panel 11 cooperate to define an opening 19 (FIG. 2) into the package 10. As will be further described below, the inner surface of the tab 17 is sealed to the package 10 about the opening 19 to provide a leak tight closure for the opening 19. When the grip portion 17*c* of the tab 17 is first lifted and pulled upwardly, the front portion 17*a* of the tab is separated from the front panel 11. As the grip portion 17*c* of the tab 17 is pulled upwardly further, the upper portion 17*b* of the tab 17 separates from the side tongue portion 15*a* and the side tongue portion 15*b*. The tab 17 remains fixed to the rear tongue portion 15*c*, which remains attached to the upper marginal edge of the back panel 12 of the package 10. The marginal areas of the top panel 15 between the tongue portion 15*c* and each of the side tongue portions 15*a* and 15*b* are torn from the opening 19 to the upper marginal edge of the back panel 19 as the tab 17 lifts the tongue portion 15*c*. Thus, the opening 19 in the package 10 will be completely uncovered. It will be appreciated that any liquid contents of the package 10 may be easily and completely poured out of the package 10 since the opening 19 extends through the upper portion of the front panel 11 and thus no lip is present to trap a small portion of the contents of the package 10. If desired, the side tongue portions 15*a* and 15*b*, which remain attached to the upper marginal edges of the respective side panels 13 and 14 of the package 10, can then be pulled upwardly to fully open the top of the package 10 (not shown).

Figure 3A:
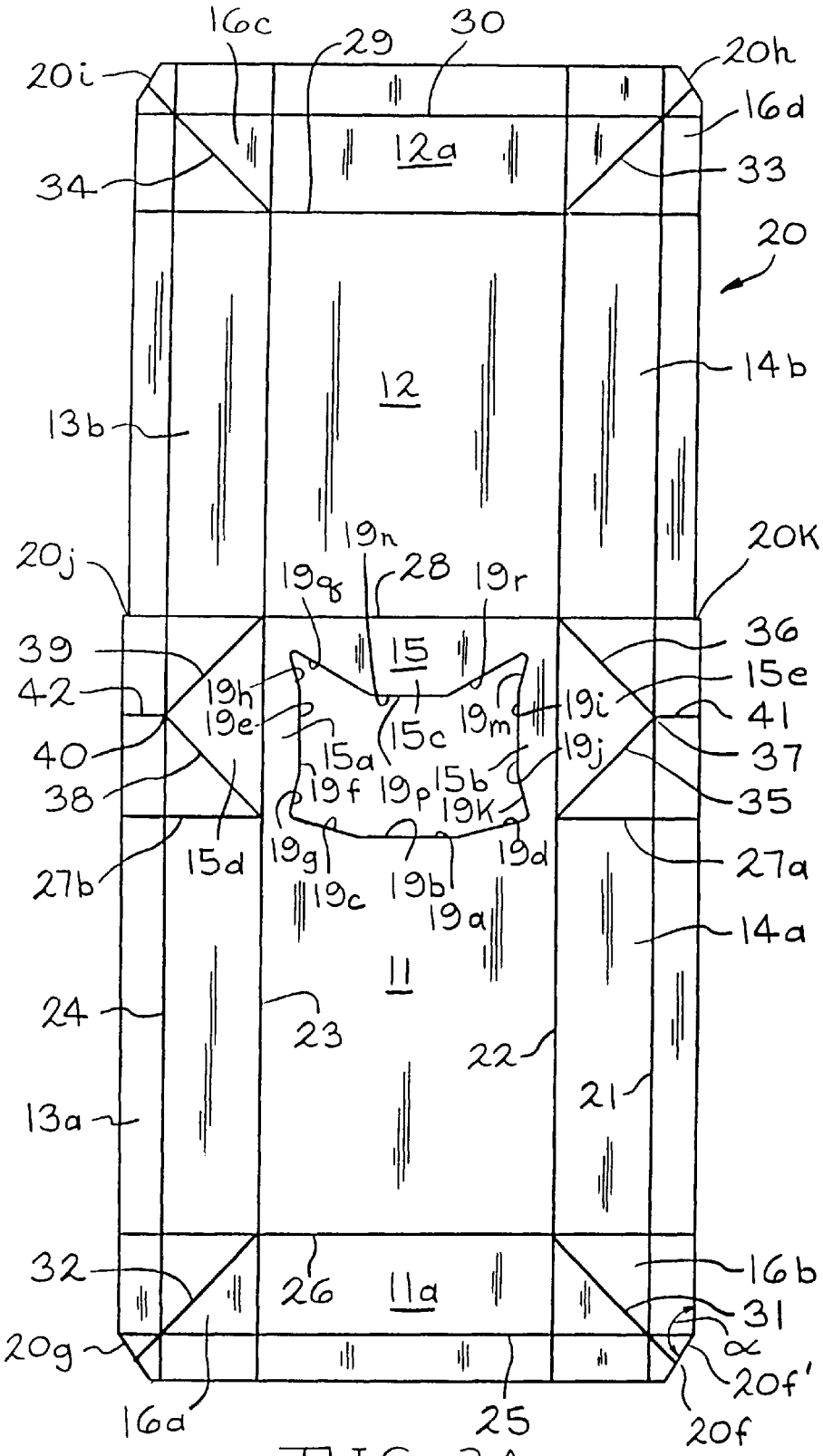
FIG. 3A is a plan view illustrating the construction of a blank of laminated paperboard material which is utilized to construct the package of FIGS. 1 and 2.

Referring now to FIG. 3A, there is shown a plan view of a paperboard main blank 20 in accordance with the present invention. The blank 20 is generally rectangular in shape. The package 10 is constructed from the blank 20 in conjunction with the tab 17 (FIG. 3B), which is formed as separate paperboard blank. Both the main blank 20 and the tab 17 may be conventionally constructed of paperboard having respective paper cores 20*a* and 17*d*. The blank 20 may be provided with a coating 20*b* on an outer face of the core 20*a* and provided with a coating 20*b* on an inner face thereof. An outer face of the core 17*d* of the tab 17 may be provided with a coating 17*e*, while an inner face thereof may be covered with a coating 17*f*. The specific coating materials to be used for the coatings 17*e*, 17*f*, 20*a*, and 20*b* depends in part upon the material to be stored in the package 10. Furthermore, the coating material 20*b* to coat the inner face of the blank 20 need not be the same as the coating material on the outer face of the blank 20. Similarly, the coating 17*f* on the inner face of the tab 17 need not be the same material as the coating 17*f* the outer face of the tab 17, and further, the coatings 17*e* and 17*f* on the tab 17 may be different from the coatings 20*b* and 20*c* on the blank 20. Thus the coatings 20*b* and 17*f* on the inner faces of the blank 20 and the tab 17, which will form the inner surface of the package 10, may be selected to have desirable characteristics for containing the material in the package 10 during processing and storage. Similarly, the coating 20*b* which is on the face of the blank 20 which will form the outer surface of the package 10, may be a coating such as polyethylene, which will permit two portions of the surface to be bonded together by applying relatively low heat thereto and pressing the portions together. Coating the exterior surface of the blank 20 with such a heat-bondable material will also facilitate fabrication of the blank 20 into the package 10 by the method of the present invention, which will be described below. As will be further described below, the tab 17 is preferably heat bonded to the blank 20. In this process, the blank 20 is heated to melt the outer coating 20*b*. The tab 17 is also heated to melt the inner coating 17*f* and then pressed against the outer surface of the blank 20.

Figure 3B:
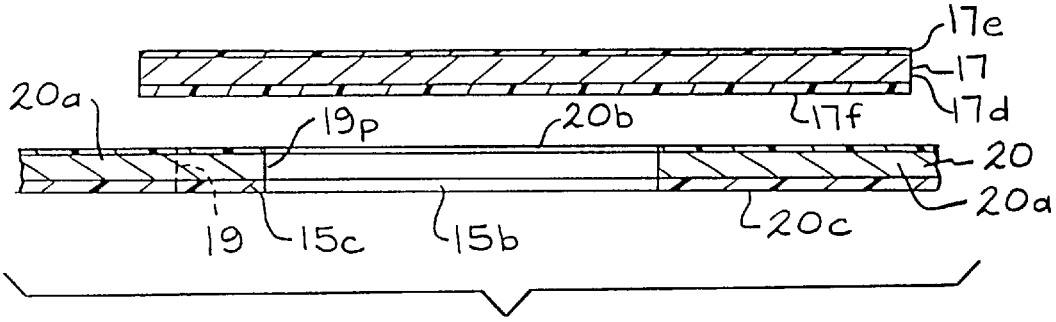
FIG. 3B is a sectional view taken along the line 3B—3B of FIG. 3A, along with a sectional view of the adjacent portions of a tab for covering an opening through the blank of FIG. 3A.
Figure 3C:
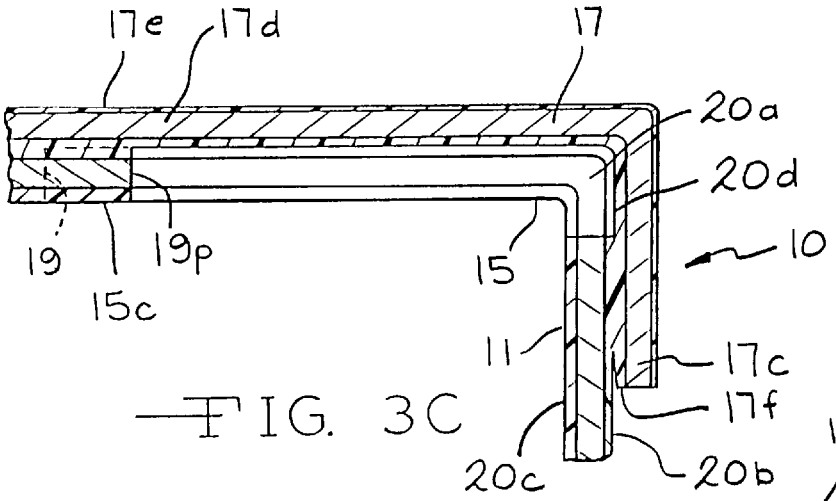
FIG. 3C is a partial sectional view similar to that of FIG. 3B, showing the tab assembled onto the blank, and the blank formed into the package illustrated in FIG. 1.
Figure 3D:
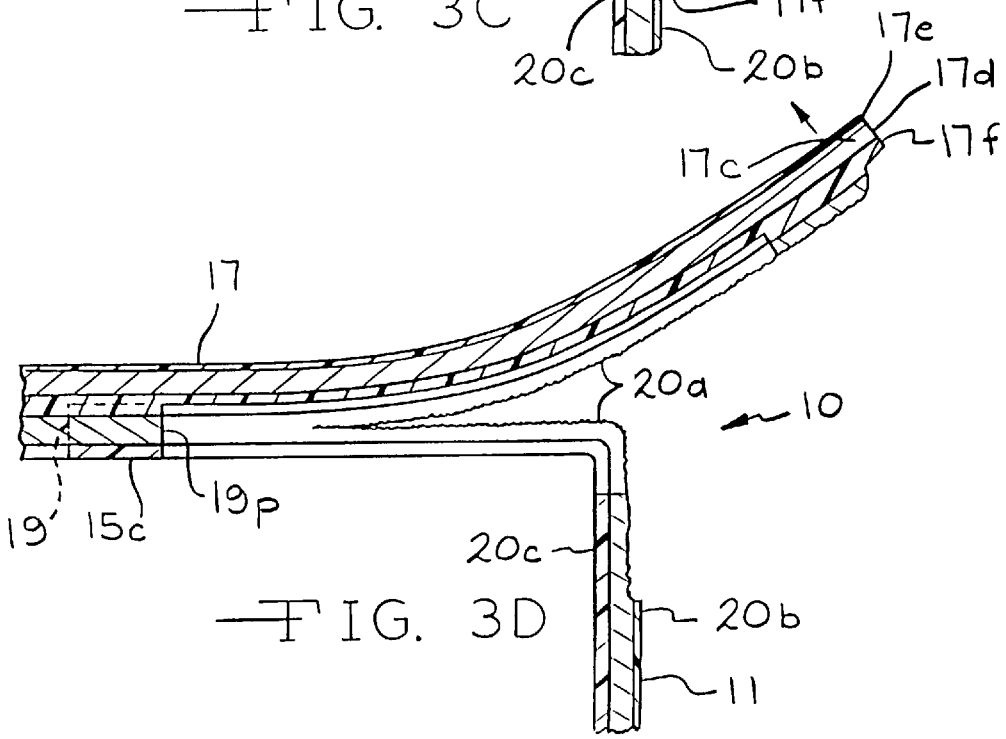
FIG. 3D is a view similar to FIG. 3C, showing the package partially opened.

Referring now to FIGS. 3C and 3D, one arrangement which has been found to be suitable is to form both the blank 20 and the tab 17 of medium density paperboard. Polyethylene coatings 20*b* and 17*e* of about 0.5 mil thickness are provided on the outer surfaces of the blank 20 and the tab 17, respectively, as shown in FIG. 3B. Polyethylene coatings 20*c* and 17*f* of about 1.5 mil thickness are provided on the inner surfaces of the blank 20 and the tab 17, respectively. When the relatively thick inner coating 17*f* of polyethylene of the tab 17 is heat bonded to the relatively thin outer coating 20*b* of polyethylene of the blank 20 (FIG. 3C), it has been found that the fused polyethylene layers 17*f* and 20*b* will remain bonded to the tab 17 when the tab 17 is pulled upwardly from the sealing area about the opening 19 (FIG. 3D). The fused polyethylene layers 17*f* and 20*b* will preferably cause the paper core of the blank 20 to split in the region of the sealing area about the opening 19, with a portion of the paper core being pulled away from the blank 20 with the fused polyethylene layers bonded to the tab 17, as indicated by the stippled area in FIG. 2. In this manner it can be assured that the opening 19 will be fully opened, since the tab 17 remains intact during opening.

Those of ordinary skill in the art will recognize that at times under production conditions the polyethylene layers 17*g* and 20*b* may not completely fuse into a single fused layer 20*d*, but merely adhere to one another. In such a situation, the layer 17*g* may be pulled upwardly with the nylon layer 17*f* as the tab 17 is opened, while the layer 20*b* remains fixed to the unsplit paper core 20*a* of the blank 20. Thus, it will be appreciated that this situation also results in the opening 19 into the package 10 being fully uncovered.

Figure 3E:
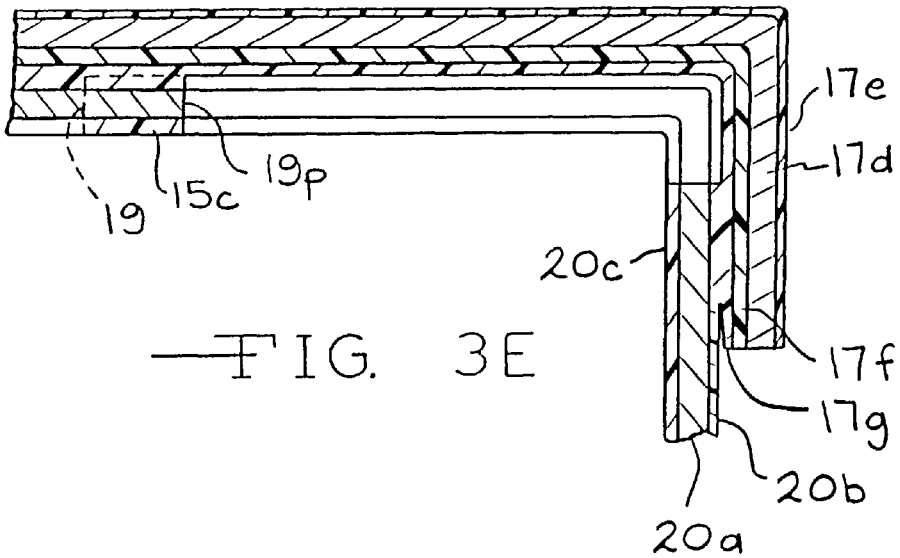
FIG. 3E is a view similar to that of FIG. 3C, showing an embodiment where a second layer of thermoplastic material is applied to the inner surface of the tab.

Referring now to FIG. 3E, another combination of coating materials which has been found to be useful is to make the coatings 20*b*, 20*c*, and 17*e* on each face of the blank 20 and on the outer face of the tab 17, respectively, of polyethylene. The coating on the inner face of the tab 17 is co-extruded nylon and polyethylene, with a nylon layer 17*f* next to the paper core 17*d* of the tab 17 and an outer polyethylene layer 17*g*. After the tab 17 is fixed to the blank 20, the polyethylene layers 17*g* and 20*b* form a single fused layer 20*d*. The nylon layer 17*f* of the tab 17 and the paper core of the blank 20 are both tightly bonded to the adjacent fused layer 20*d*. The nylon layer 17*f* on the tab 17 has greater strength than the paper core 20*a* of the blank 20. Therefore, when the tab 17 is pulled upwardly to open the package 10, as described above, the tab 17 will remain intact as the seal around the opening 19 is broken. Instead, the paper core 20*a* of the blank 20 will be split in the upper panel 15 and the front panel 11, and a portion of the paper core 20*a* will be pulled away from the remaining paper core of the blank 20 and remain bonded to the tab 17, as indicated by the stippled areas in FIG. 2. Thus, the opening 19 into the package 10 is fully uncovered when the tab 17 is pulled upwardly, since the tab 17 remains intact during opening, and will not split to leave layers thereof obstructing the opening 19.

Those of ordinary skill in the art will thus recognize that many alternative methods may be used to ensure that the paper core of the tab 17 and the coatings thereon are not split and left extending over the opening 19 in the blank 20 when the tab 17 is lifted. For example, the paper core of the tab 17 may be formed of a stock which is relatively stronger than the stock from which the paper core of the blank 20 is formed. Those of ordinary skill in the art will also recognize that other means may be used to secure the tab 17 to the blank 20, such as through the use of adhesives. Additionally, it will be appreciated after studying the following disclosure that the tab 17 and blank 20 may be heated while being, pressed together, through the use of ultrasonic heating devices.

Figure 3F:
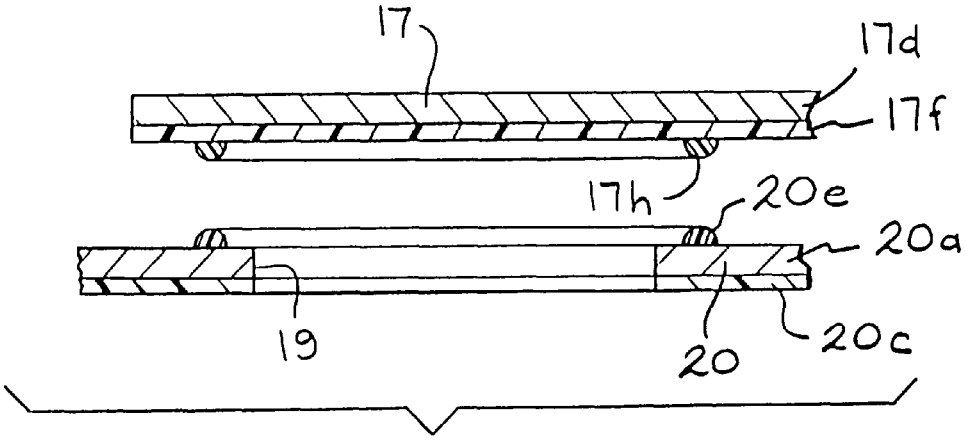
FIG. 3F is a view similar to that of FIG. 3C, showing an embodiment where a printable heat seal material is applied to specific locations on the outer surface of the blank and inner surface of the tab.
Figure 3G:
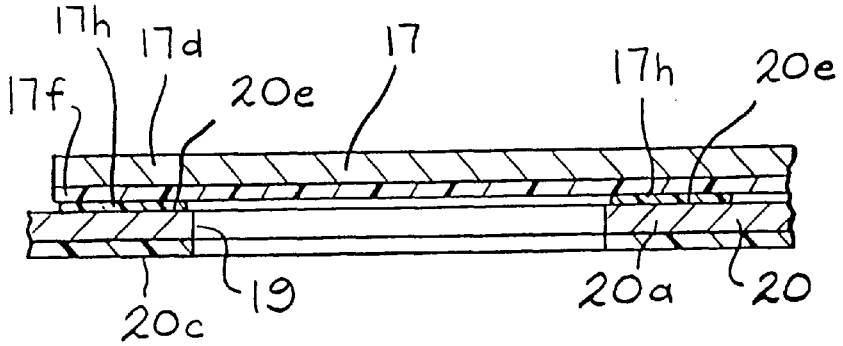
FIG. 3G is a view similar to that of FIG. 3F, showing the tab assembled onto the blank.

Furthermore, it will be appreciated by those of ordinary skill in the art that various thermoplastic materials, including polymeric thermoplastic materials can be used as coatings for the blank 20 and the tab 17. However, those in the art will also recognize that various combinations of coatings or absence of coatings may be desirable, depending upon the desired use of the package 10. For example, as shown in FIG. 3F, the blank 20 and the tab 17 are formed with layers 20*c* and 17*f* of plastic coating material, such as polyester, covering the respective inner faces thereof. No outer coating layer covers the respective outside faces thereof. Instead, bonding materials 20*e* and 17*h* are applied only to selected areas of the external face of the blank 20 and the internal face of the tab 17, respectively, where sealing will be required during forming of the package 10. Examples of bonding materials 20*e* and 17*h* which may be suitable for selective application include thermoplastics with relatively low melting points compared to the material forming the layers 20*c* and 17*f*, various adhesives, or printable heat seal materials. Completely covering only the inner surface of the package 10 with plastic material will reduce the amount of plastic utilized to form the package 10, which can lower fabrication costs, and will also reduce the amount of non-biodegradable plastic waste produced when the package 10 is ultimately disposed of by a user. The lack of a continuous plastic outer layer will also expose the paper core of the package 10 to the environment, allowing the core to decompose more quickly if the package 10 is disposed of by burial.

Prior to discussing the steps required to form the package 10, the various panel sections and fold lines of the blank 20 will be discussed with reference to FIG. 3A. The blank 20 is precut into the predetermined configuration shown in FIG. 3A. The blank 20 is a longitudinally extending, generally rectangular sheet of paperboard material. The four corners 20*f*, 20*g*, 20*h* and 20*i* of the blank 20 are preferably not formed as right angles, but rather are trihedral. The corner 20*f*, like the corners 20*g*, 20*h*, and 20*i*, includes an edge 20*f* extending at an angle to each of the adjacent longitudinal edge and the adjacent transverse edges of the blank 20. Preferably, the edge 20*f*' of the corner 20*f* forms an angle $\alpha$ of approximately 135 to 150 degrees to the adjacent longitudinal edge of the blank 20. As shown in FIG. 3A, each of the other corners 20*g*, 20*h*, and 20*i* are formed with an edge at a similar angle to the respective adjacent longitudinal edge of the blank 20.

The blank 20 is provided with a plurality of scored fold lines. The fold lines define locations along which the blank 20 is either temporarily or permanently folded during the construction of the package 10. The blank 20 is provided with longitudinal fold lines 21, 22, 23, and 24, and transverse fold lines 25, 26, 27*a*, 27*b*, 28, 29, and 30. Note that although the fold line 27*a* is collinear with the fold line 27*b*, preferably no fold line is scored in the portion of the blank 20 which will form the top panel 15, for reasons which will be discussed below.

Diagonal fold lines 31, 32, 33, and 34 extend from respective corners 20*f*, 20*g*, 20*h*, and 20*i* of the blank 20 to, respectively, the intersections of the fold lines 22 and 26; 23 and 26; 22 and 29; and 23 and 29. The fold lines 31, 32, 33, and 34 extend, respectively, through the intersections of the fold lines 21 and 25; 24 and 25; 21 and 30; and 24 and 30. The diagonal fold lines 31 through 34 are formed at a 45 degree angle to the longitudinal fold lines 21 through 24, and to the transverse fold lines since the transverse fold lines are perpendicular to the longitudinal fold lines.

Additional diagonal fold lines 35 and 36 extend from a point 37 defined on the longitudinal fold line 21 midway between the fold lines 27*a* and 28. The fold line 35 extends to the intersection of the fold lines 22 and 27*a*. The fold line 36 extends from the point 37 to the intersection of the fold lines 22 and 28. Similarly, diagonal fold lines 38 and 39 extend from a point 40 on the longitudinal fold line 24. The point 40 is defined midway between the fold lines 27*b* and 28, to the intersections of the fold lines 23 and 27*b*, and of the fold lines 23 and 28, respectively. The diagonal fold lines 35, 36, 38 and 39 are formed at 45 degree angles to the associated longitudinal fold line 21 or 24. A transverse fold line 41 extends laterally outwardly from the point 37 to the adjacent edge of the blank 20. Similarly, a transverse fold line 42 extends laterally outwardly from the point 40 to the adjacent edge of the blank 20. Finally, although not shown in the drawings, a predetermined decorative pattern may be embossed into the blank 20 or the tab 17, if desired.

The two longitudinal peripheral edges of the blank 20 are preferably stepped inwardly a small distance toward one another along the fold line 28 to form steps 20*j* and 20*k*. Thus the blank 20 may be seen as being formed of two generally rectangular portions separated by the fold line 28, one portion including the front panel 11, the other portion including the back panel 12. The two portions cooperate to define the pair of opposed steps 20*j* and 20*k* in the marginal edge of the blank 20. The blank 20 is thus wider from edge to edge thereof across the front panel 11 than from edge to edge across the back panel 12. The purpose of the steps 20*j* and 20*k* will be discussed below.

Figure 6:
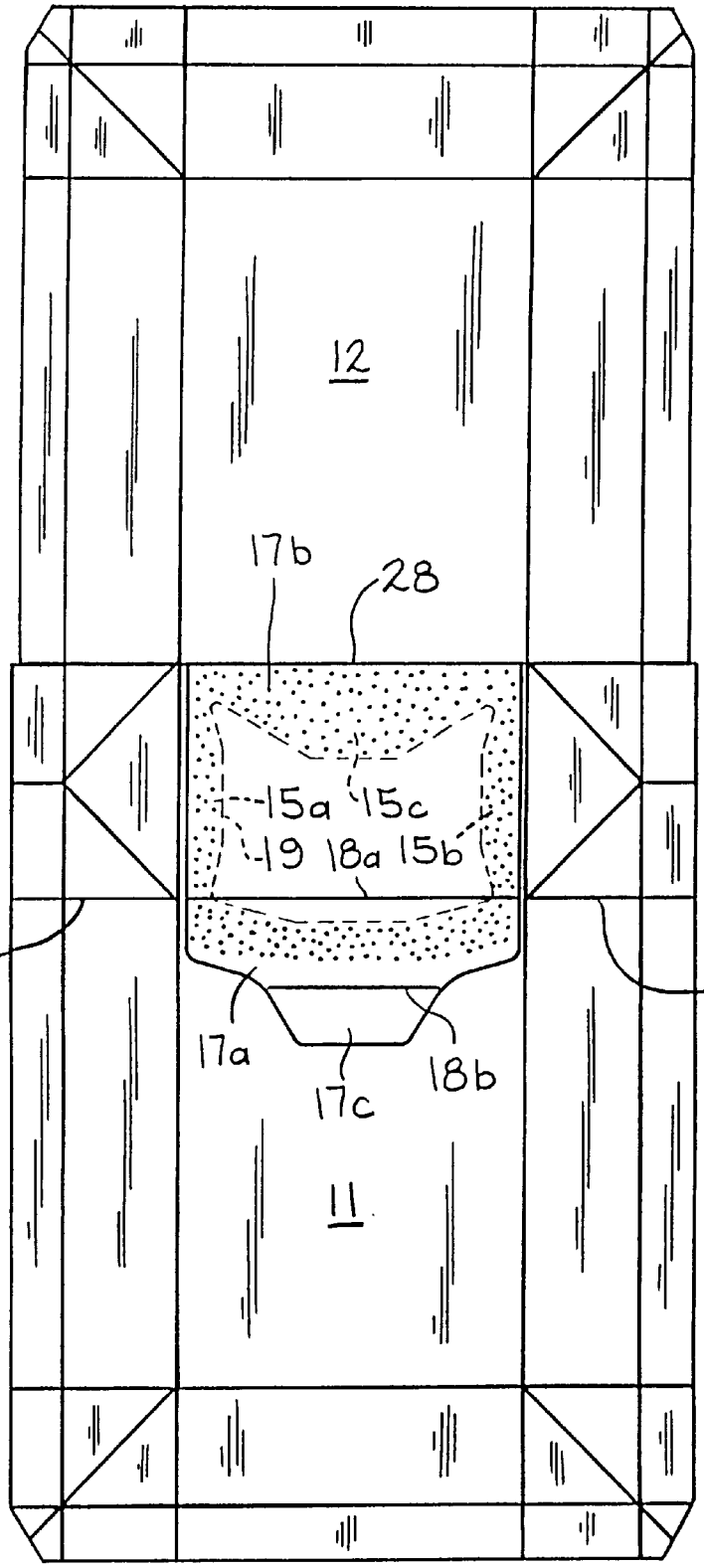
FIG. 6 is a view similar to FIG. 3A, showing the package after the tab has been heat sealed to the outer surface of the blank.

As shown in FIGS. 1 and 15, the completed package 10 includes three panels which may be formed from a continuous and seamless layer of material, which is preferably a laminated paperboard material. These three panels, which are also shown in FIGS. 3A and 6, include the top panel 15, the front panel 11 and the rear panel 12. The top panel 15 is of rectangular configuration and is bounded by the longitudinal fold lines 22 and 23 and the transverse fold line 28 and the portion of the blank 20 which lies beneath the fold line 18*a* on the tab 17. The front panel 11 is defined by the longitudinal fold lines 22 and 23, the transverse fold line 26 and the portion of the blank 20 which lies beneath the fold line 18*a* on the tab 17. The rear panel 12 is defined by the longitudinal fold lines 22 and 23 and the transverse fold lines 28 and 29.

A first top panel extension 15*d* is connected to the top panel 15 along the longitudinal fold line 23, and is located between the transverse fold lines 27*b* and 28. A second top panel extension 15*e* is connected to the top panel 15 along the longitudinal fold line 22, and is located between the transverse fold lines 27*a* and 28.

The bottom panel 16 (shown in FIG. 15) is formed from the cooperation of front and rear bottom extensions 11*a* and 12*a*. The front bottom extension 11*a* represents the lower portion of the blank 20 shown in FIGS. 3A and 6, and is foldably connected to the front panel 11 along the fold line 26 between the longitudinal fold lines 22 and 23. The rear bottom extension 12*a* represents the upper portion of the blank 20 shown in FIGS. 3A and 6, and is foldably connected to the rear panel 12 along the fold line 29 between the longitudinal fold lines 22 and 23.

A first bottom panel extension 16*a* is foldably connected to the front bottom extension 11*a* along the fold line 23 and to the front first side extension 13*a* along the fold line 26. A second bottom panel extension 16*b* is foldably connected to the front bottom extension 11*a* along the fold line 22 and to the front second side extension 13*a* along the fold line 26. A third bottom panel extension 16*c* is foldably connected to the rear bottom extension 12*a* along the fold line 23 and to the rear first side extension 13*b* along the fold line 29. Finally, a fourth bottom panel extension 16*d* is foldably connected to the rear bottom extension 12*a* along the fold line 22 and to the rear second side extension 14*b* along the fold line 29.

The first side panel 13 (shown in FIGS. 2 and 15) is formed from front and rear first side extensions 13*a* and 13*b* which are connected to the front and rear panels 11 and 12, respectively, along the fold line 23. In particular, the front first side extension 13*a* is bounded by the longitudinal fold line 23 and the transverse fold lines 26 and 27*b*. The rear first side extension 13*b* is bounded by the longitudinal fold line 23 and the transverse fold lines 28 and 29. Similarly, the second side panel 14 (shown in FIG. 1) is formed by the cooperation of front and rear second side extensions 14*a* and 14*b*. The front second side extension 14*a* is connected to the front panel 11 along the longitudinal fold line 22, and is located between transverse fold lines 26 and 27*a*. The rear second side extension 14*b* is connected to the rear panel 12 along the longitudinal fold line 22, and is located between the transverse fold lines 28 and 29.

The opening 19 is formed through portions of the front panel 11 and the top panel 15 of the blank 20. The front edge

19*a* of the opening 19 is bowed outwardly, and is preferably formed of a center line segment 19*b*, and two side segments 19*c*, and 19*d*. The center segment 19*b* extends transversely, parallel to the fold line 28. The two side segments 19*c*, and 19*d* extend at equal angles, preferably about 165 degrees, to the center segment 19*b*.

A first side edge 19*e* of the opening 19 is defined along the side tongue portion 15*a*, and thus is inwardly bowed. The first side edge 19*e* is preferably formed of three line segments, including a longitudinally extending center side segment 19*f*, a front side segment 19*g*, and a rear side segment 19*h*. The front side segment 19*g* extends outwardly at an angle, preferably about 165 degrees, to the center side segment 19*f*. The front side segment 19*g* forms an angle, preferably a right angle, to the side segment 19*c*, with the included corner being suitably radiused. The rear side segment 19*h* also extends outwardly from the center side segment 19*f*, preferably also at an angle of about 165 degrees thereto. The straight line distance between the end of the front side segment 19*g* adjacent the front panel 11 and the end of the rear side segment 91*h* adjacent the rear panel 12 is the width of the side tongue portion 15*a*.

A second side edge 19*i* of the opening 19 is defined along the side tongue portion 15*b*. The second side edge 19*i* is a mirror image of the first side edge 19*e*, and includes a longitudinally extending center side segment 19*j*, and front and rear side segments 19*k* and 19*m* formed at equal angles of about 165 degrees thereto. The front side segment 19*k* preferably forms a right angle to the side segment 19*d*, with the included corner being radiused. The corners formed between the front side segment 19*g* and side segment 19*c* and between the front side segment 19*k* and the side segment 19*d* are preferably aligned with the fold lines 27*a* and 27*b*. The width of the side tongue portion 15*b* is defined, in a manner like that of the tongue portion 15*a*, as the linear distance between the ends of the front side segment 19*k* and the rear side segment 19*m* which are farthest apart. The width of the second tongue portion 15*b* is preferably the same as the width of the first tongue portion 15*a*.

A rear edge 19*n* of the opening 19 is defined along the rear tongue portion 15*c*, and thus is inwardly bowed. The rear edge 19*n* is preferably formed of three line segments, including a transversely extending center segment 19*p*, a first side segment 19*q*, and a second side segment 19*r*. The first side segment 19*q* extends outwardly at an angle, preferably about 160 degrees, to the center segment 19*p*. The first side segment 19*q* forms an angle, preferably about 55 degrees, to the rear side segment 19*h* of the first side edge 19*e*, with the included corner being suitably radiused. The second side segment 19*r* similarly extends outwardly from the center segment 19*p*, preferably also at about a 160 degree angle thereto. The rear tongue portion 15*c* has a length which is defined as the minimum distance between the center edge segment 19*p* and a straight line (not shown) which could be drawn to include the end points of the first side segment 19*q* and the second side segment 19*r* which are adjacent the fold line 28. Preferably, the length of the rear tongue portion 15*c* is less than one third the width of the side tongue portion 15*a* or the side tongue portion 15*b*.

Figure 4A:
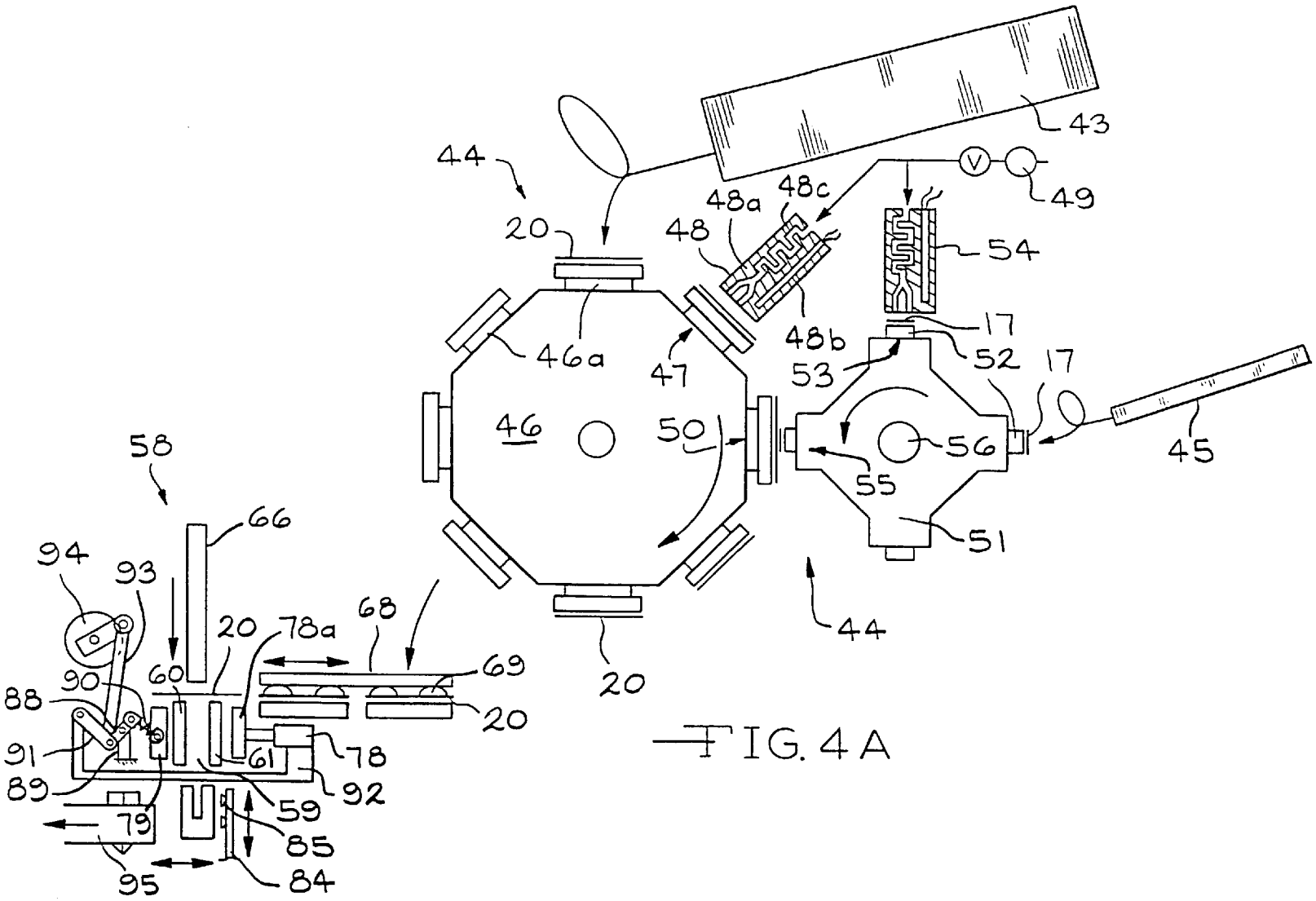
FIG. 4A is a schematic view illustrating the first portion of the various steps in fabricating a package according to the preferred embodiment of the invention.
Figure 4B:
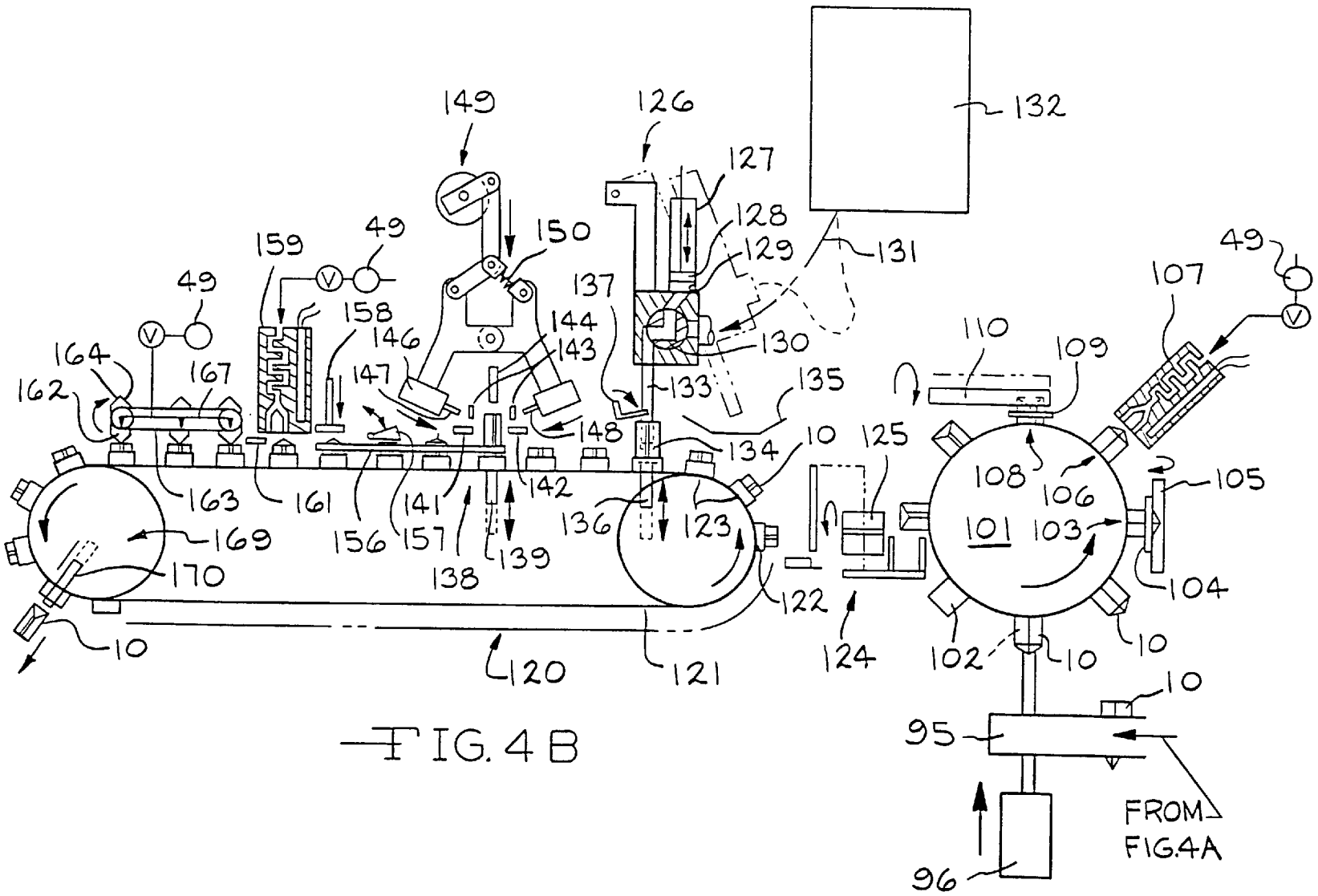
FIG. 4B is a schematic view illustrating the second portion of the various steps in fabricating a package according to the preferred embodiment of the invention.

Referring now to the schematic diagram of FIGS. 4A and 4B, the blank 20 and the tab 17 are sequentially fed through a plurality of stations adapted to joint the tab 17 to the blank 20, and to form the blank 20 into the package 10. Although the following description will follow the path for processing a single blank 20, those of ordinary skill in the art will recognize that processing equipment having multiple parallel processing paths may be used to increase the rate of production of the packages 10. Additionally, it should be noted that FIGS. 4A and 4B illustrate each station operating relatively independently of one another for maximum clarity of illustration. In practice however, the stations will preferably be controlled by a central process controller or computer (not shown) which may coordinate the operations of the various stations differently than illustrated in order to achieve maximum speed and efficiency.

A plurality of blanks 20 may be loaded into a suitable feed device such as, for example, a magazine 43, and temporarily stored until transferred into an assembly station 44. Similarly, a plurality of tabs 17 may be loaded into a suitable feed device such as a tab magazine 45, and temporarily stored until transferred into the assembly station 44. The assembly station 44 is a mechanism for positioning the blank 20 and the tab 17, and for securing the tab 17 to the blank 20. One suitable mechanism which has been used includes a blank indexing wheel 46 having a plurality of circumferentially spaced blank carriers 46*a*. Each blank 20 is temporarily held on a respective one of the blank carriers 46*a* by, for example, vacuum suction. The blank 20 is moved to a first position 47, where the area of the blank 20 about the opening 19 is heated by a heater assembly 48, causing the thermoplastic coating thereon to melt. Following heating, the blank 20 is then moved to a second position 50 for joining with a respective tab 17.

The heater assembly 48 is of a novel design which has been found to have several advantages over the continuously or intermittently operating "blow dryer" type heaters which have hitherto typically been used to heat paperboard blanks, including increased operating efficiency and decreased heating of the surrounding spaces. The heater assembly 48 includes a body 48*a* which is preferably formed of a material, such as copper or brass, which is easily formed and which will readily absorb and readily transfer heat. At least one electric heater element 48*b* is disposed to heat the body 48*a* from within a bore in the body 48*a*. A labyrinth passageway 48*c* is formed through the body 48*a*. Such a passageway 48*c* may be formed, for example by machining a circuitous path in various faces of the body 48*a*, perhaps connected by bores through the body 48*a*. The path machined in the faces of the body 48*a* may then be covered with a plate for each machined face to form a conduit which is part of the passageway 48*c*. The passageway 48*c* will preferably be sub-divided into a plurality of outlet paths which are spaced about the periphery of the opening 19 in the blank 20 when the blank 20 is held in the first position 47 of the blank indexing wheel 46. If desired, thermal insulation (not shown) may be placed around the body 48*a*. Additionally, if desired, the heater element 48*b* may be disposed within the labyrinth passageway 48*c*, provided the heater element 48*b* does not unduly restrict air flow through the labyrinth passageway 48*c*.

In operation, the heater element 48*b* is energized to heat the body 48*a*, resulting in the heating of the air contained within the passageway 48*c*. When a blank 20 is moved to the position 48*a* to be heated, a short burst of air from a source of pressurized air 49 is admitted into the passageway 48*c*. The air which was previously heated in the passageway 48*c* is displaced therefrom and is directed onto the blank 20, to provide the necessary heating. Once the blank 20 has been sufficiently heated, a valve is closed to again isolate the pressurized air source 49 from the heater assembly 48. The heated body 48*a* then heats the new charge of air contained within the passageway 48*c* therethrough. Thus it is apparent that air is only passed through the heater assembly 48 when the blank 20 is properly position and the heated air is very substantially directed onto the blank 20. In addition to minimizing undesired heating of surrounding spaces, this arrangement decreases the peak power requirements for heating. The body 48*a* has a relatively large mass to provides a thermal reservoir into which and from which a relatively large amount of heat can be transferred. A relatively small heating element 48*b* can heat the air contained in the body 48*a* not only when the air is blowing onto the blank 20, as with the "blow dryer" type heaters, but also during the period when no air is moving through the body 48*a* of the heater assembly 48. Since the heating element 48*b* has a relatively longer time to add heat to the air to be used to heat the blank 20, the heating element 48*b* can be of a lower wattage than a "blow dryer" type heater used for the same service. The circuitry (not shown) supplying power to the heating element 48*b* thus need not be rated to handle as much power, and can be correspondingly less expensive. The heating element 48*b* may not need to be continuously energized, but may be turned on and off based on the temperature of the body 48*a*. This feature can be especially useful when there are periodic interruptions in the production of the packages 10. Even when the heating element 48*b* is turned off, heated air will be instantly available when the blank 20 is properly positioned, because of heat retained in the body 48*a*. The volume of the passageway 48*c* and the temperature at which the body 48*a* is maintained should be selected such that the volume of air gains enough heat during the dwell time in the passageway 48*c* to effectively melt the thermoplastic material onto which the heated air is directed.

Figure 5:
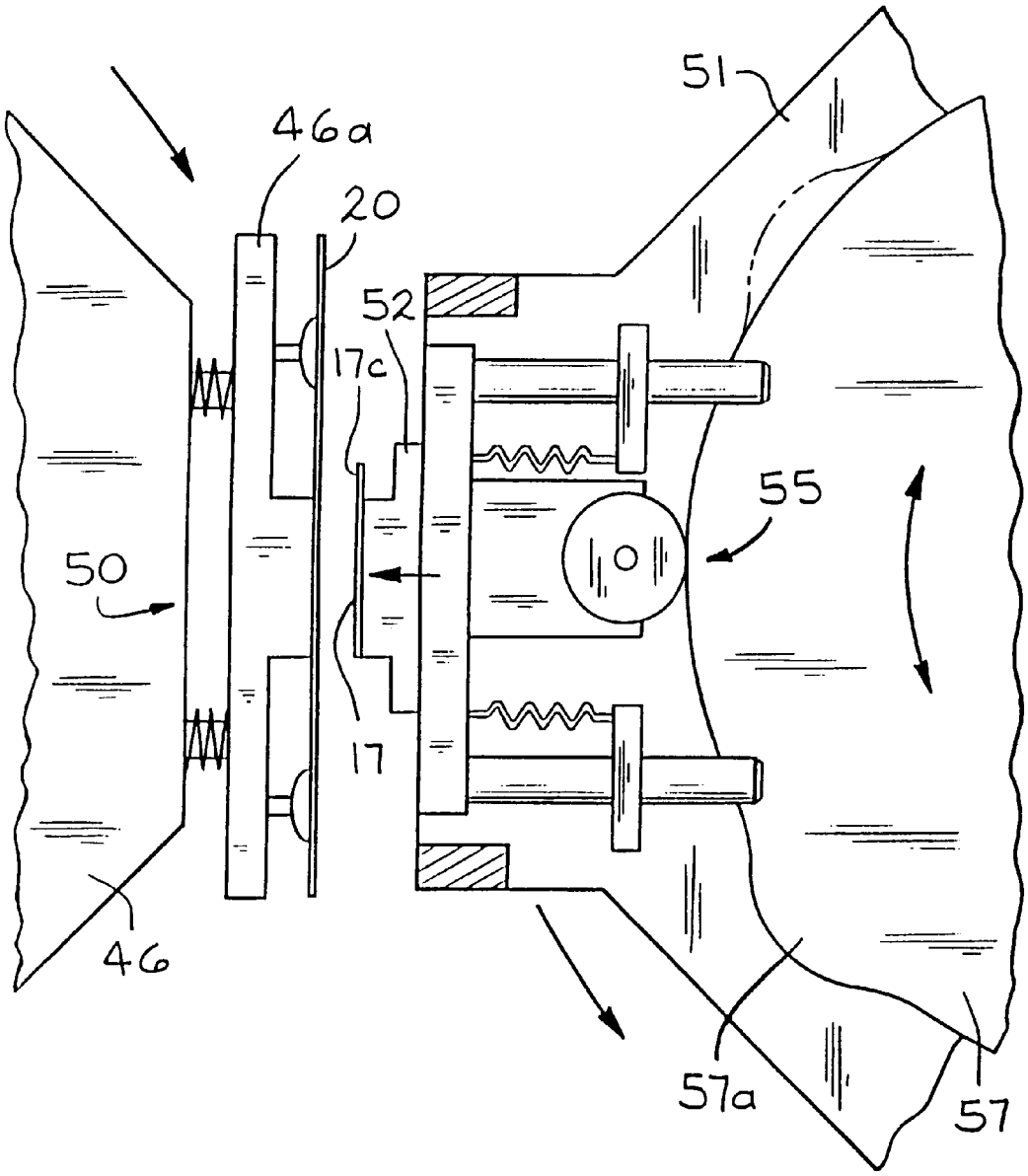
FIG. 5 is a side elevational view of an assembly station where a tab is pressed onto the blank of the invention.

Referring now to FIGS. 4A and 5, the assembly station 44 also includes a tab indexing wheel 51 having a plurality of circumferentially spaced tab carriers 52. As will be further discussed below, each tab carrier 52 may be moved radially inwardly and outwardly with respect to the tab indexing wheel 51. Each tab 17 is transferred from the tab magazine 45 onto a respective one of the tab carriers 52, where the tab 17 is held by, for example, vacuum suction. The tab 17 is moved to a first position 53, where outer periphery of the inner surface of front portion 17*a* and the top portion 17*b* of the tab 17 are heated by a heater assembly 54 to cause the thermoplastic layer of the coating thereon to melt. The heater assembly 54 is similar in construction and operation to the heater assembly 48, although, of course, the specific arrangement of outlet paths will be different to properly direct heated air toward the front portion 17*a* and top portion 17*b* of the tab 17. No heated air is directed to the grip portion 17*c* of the tab 17, consequently the thermoplastic layer thereon is not heated sufficiently to melt. The tab 17 is then moved to a second position 55 where the tab 17 is pressed onto the blank 20 in the position 50 of the blank indexing wheel 46. As shown in FIG. 5, the top portion 17*b* of the tab 17 is positioned to cover the opening 19, shown in broken line, and portion of the blank 20 which will be formed into the top panel 15. The fold line 18*a* of the tab 17 is aligned with the transverse fold lines 27*a* and 27*b* of the blank 20. The grip portion 17*c* of the tab 17 extends beyond the edge of the tab carrier 52, and thus is not pressed against the blank 20, further ensuring that the grip portion 17*c* is not directly fixed to the blank 20.

The tab indexing wheel 51 is journaled for rotation about a supporting shaft 56. A cam 57, also supported on the shaft 56 is oscillated through a partial rotation between a first position, illustrated in solid line in FIG. 5, and a second position, illustrated in dashed line therein. The cam 57 periodically drives a cam lobe 57*a* thereof against the tab carrier 52, when the tab carrier 52 is in the second position 55 thereof. Thus, after each tab carrier 52 is rotated into the second position 55, the cam lobe 57*a* is moved upwardly to drive the tab carrier 52 radially outwardly to an extended position, toward a respective one of the blank carriers 46*a* in the second position 50 thereof. The tab 17 is pressed onto the blank 20 by the extended blank carrier 46*a*. The respective melted thermoplastic layers fuse, sealing around the opening 19 in the blank 20, as indicated by the stippled area in FIG. 6. The top portion 17*b* of the tab 17 is sealed to the tongues 15*a*, 15*b*, and 15*c* of the top panel 15 of the blank 20, while the front portion 17*a* of the tab 17 is sealed to the front panel 11 of the blank 20. Note that the blank 20 preferably has no fold lines scored into the sealing area about the opening 19. This helps ensure that the tab 17 will seal completely about the opening 19, including the areas under the fold line 18*b* in the tab 17. Before the tab indexing wheel 51 is rotated to move a new tab carrier 52 into the second position 55, the tab 17 is released by the extended tab carrier 52. The cam lobe 57*a* then moves further upwardly to disengage the tab carrier 52, and the extended tab carrier 52 is retracted. The tab indexing wheel 51 is then rotated to bring a new tab 17 to the second position 55. The cam 57 rotates simultaneously with the tab indexing wheel 51 to return the cam lobe 57*a* to the first position below the position 55. As the cam 57 rotates, the cam 57 maintains the cam lobe 57*a* below the approaching tab carrier 52 carrying the new tab 17. Thus the cam 57 will only engage each tab carrier 52 once per revolution of the tab indexing wheel 51, minimizing the wear associated with reciprocating the tab carrier 52.

Figure 7:
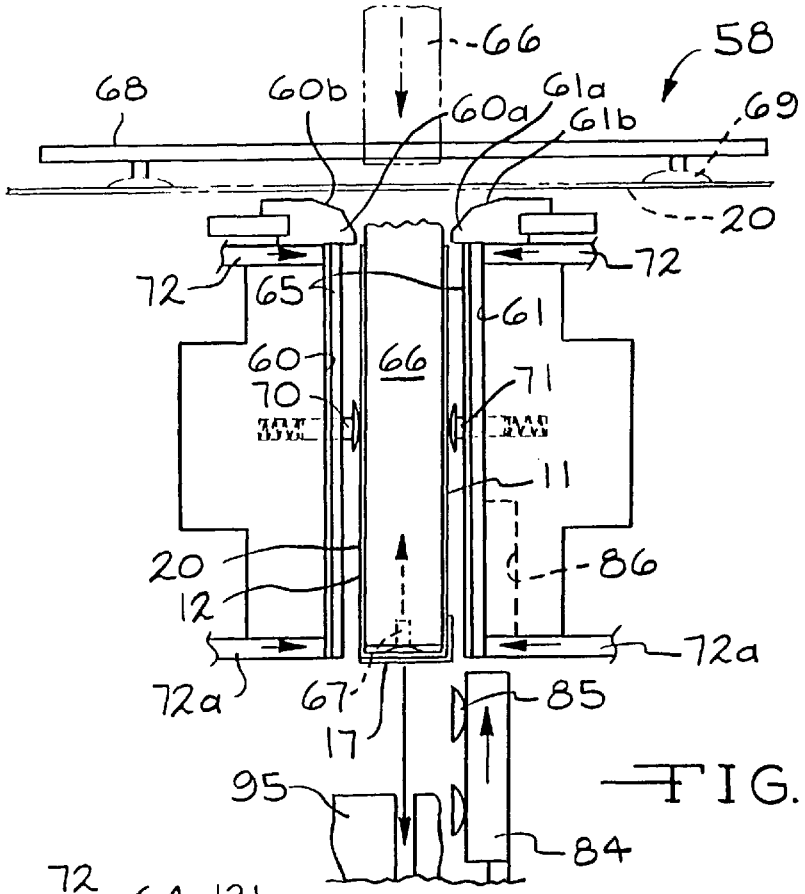
FIG. 7 is a side elevational view of the blank in a first forming station, wherein the front and rear panels are folded upwardly to a perpendicular position relative to the top panel.

Referring now to FIGS. 6 and 7, the blank 20 is transferred from the assembly station 44 to a first forming station 58. The forming station 58 comprises a center folding mechanism. The forming station 58 includes a forming cavity 59. The forming cavity 59 is defined between two opposed stationary surfaces 60 and 61. The stationary surface 60 includes an overhanging lip 60*a*. The lip 60*a* has an angled surface 60*b* for guiding the blank 20 into the forming cavity 59 in a manner which will be described below. A similar overhanging lip 61*a* is formed above the stationary surface 61, and is provided with a similarly functioning angled surface 61*b*. The forming cavity 59 is provided with two opposed side openings 62 and 63. The side openings 62 and 63 may be partially closed by, respectively, a first pair of hinged butterfly plates 64 and a second pair of hinged butterfly plates 65. The bottom of the forming cavity 59 is preferably open. The top of the forming cavity 59 is open to receive a reciprocative mandrel 66. The lower surface of the mandrel 66 is sized to fit the top panel 15 of the package 10. The mandrel 66 is preferably equipped with a suction cup 67 on the lower surface thereof to which vacuum is applied to firmly grasp the blank 20 during the forming operation. The mandrel 66 is preferably formed from a stainless steel or wear-resistant plastic.

A positioning mechanism 68 is preferably equipped with suction cups 69 mounted on the lower side of spaced apart parallel rails. A vacuum is applied to the suction cups 69 to allow the positioning mechanism 68 to carry and position the blank 20. The positioning mechanism 68 initially indexes the blank 20 with the tab 17 beneath the blank 20 and the top portion 17*b* of the tab 17 positioned above the forming cavity 59. The mandrel 66 is moved downwardly between the rails of the positioning mechanism 68, engages the blank 20 and drives the blank 20 downwardly between the opposed guiding lips 60*a* and 61*a* into the forming cavity 59, as best seen in FIG. 7

The suction cups 69 of the positioning mechanism 68 will release the longitudinal ends of the blank 20 when the mandrel 66 contacts the blank 20 and a vacuum is applied to the mandrel suction cup 67 during the initial movement of the mandrel 66. Additionally, spring loaded members 70 and 71 are provided, which extend outwardly from recesses in the stationary surfaces 60 and 61, respectively. The members 70 and 71 bear against front panel 11 and back panel 12 of the blank 20 as the blank 20 is driven past by the mandrel 66, causing friction. This friction causes a longitudinal strain in the blank 20 which keeps the blank 20 tight against the mandrel 66 after the blank 20 has been released by the suction cups 69 of the positioning mechanism 68. As the mandrel 66 is moved downwardly into the forming cavity 59, the blank 20 will be folded along the transverse fold line 28, with the back panel 12 pressed against one side of the mandrel 66. The blank 20 and the tab 17 will be folded along the transverse fold lines 27*a* and 27*b* and the fold line 18*a* of the tab 17, so that the front panel 11 is pressed against the opposite side of the mandrel 66.

In most applications, the outward appearance of the finished package 10 is an important consideration. Therefore, care should be taken to ensure the members 70 and 71 do not scuff the outside of the blank 20, detracting from the appearance of the finished package 10. To help prevent this, the spring loading of the members 70 and 71 should be relatively light. Also, the materials from which the members 70 and 71 are constructed should be selected to avoid scuffing the blank 20 under the spring tension which is selected.

Figure 8A:
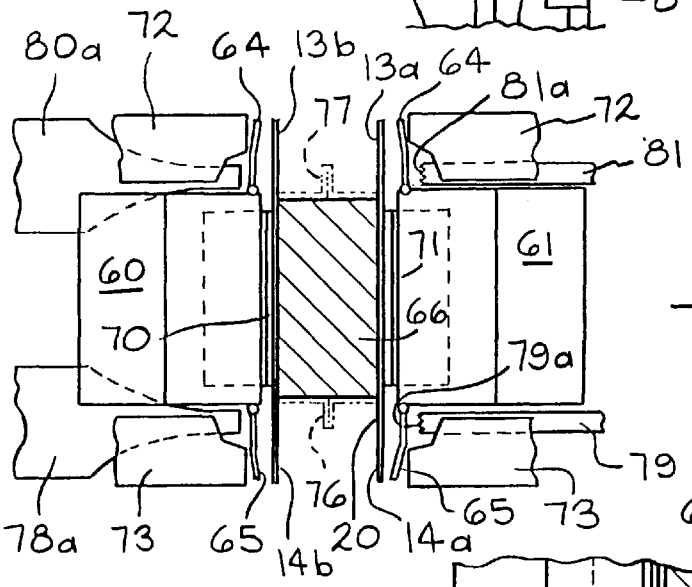
FIG. 8A is a view taken along the line 8A—8A of FIG. 7, showing how portions of the blank are forced toward one another and sealed together to form a pair of side panels having vertically extending side fin seals.
Figure 8B:
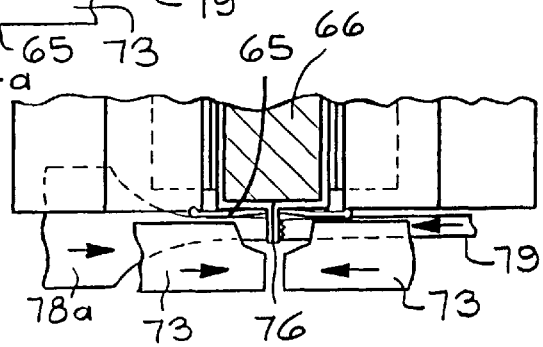
FIG. 8B is an enlarged partial view of the first forming station of FIG. 8A, illustrating the sealing of one of the side fin seals.

Referring now to FIGS. 8A and 8B, after the blank 20 is folded longitudinally by the mandrel 66 as described above, the two pairs of butterfly plates 64 and 65 are closed by opposed pairs of cams 72 and 73, respectively, moving across the side openings 62 and 63 of the forming cavity 59. Two upper pairs of cams 72 and 73 are illustrated in FIG. 8A, and are adapted to engage the upper ends of the first and second butterfly plates 64 and 65, respectively. A pair of cams 72*a* (FIG. 7) and another pair (not shown) are provided to engage the lower ends of the pairs of butterfly plates 64 and 65. These additional cams act in unison with the upper pairs of cams 72 and 73 to operate the respective pairs of spring-loaded butterfly plates 64 and 65. It should be understood, therefore, that when the operation or characteristics of the upper pairs of cams 72 and 73 are described, the operation of the lower pairs of cams will be similar. The pairs of cams 72 and 73 are preferably formed of a material such as nylon, which can repeatedly slide relative to the associated pairs of butterfly plates 64 and 65 without wearing excessively or causing excessive wear in the associated butterfly plates. The plates in each of the pairs of butterfly plates 64 and 65 may suitably be formed of a stainless steel.

When the first pair of butterfly plates 64 closes, the front first side extension 13*a* and the rear first side extension 13*b* are folded inwardly along the fold line 23 to form the first side panel 13, illustrated in FIG. 8B and shown in dashed line in FIG. 8A. Similarly, when the second pair of butterfly plates 65 closes, the front second side extension 14*a* and the rear second side extension 14*b* are folded inwardly along the fold line 22 to form the second side panel 14. The fold lines 22 and 23 are aligned over corners of the mandrel 66. Thus the blank 20 is wrapped about the mandrel 66, which support the blank 20 during the folding thereof by the pairs of butterfly plates 64 and 65. Simultaneously, the blank 20 will fold along the fold lines 22, 23, and 36 through 42 to form a pair of downwardly extending ears 74 and 75, as shown in FIG. 9. Note that because the pivot point for each of the butterfly plates 64 and 65 is disposed very close to the associated fold lines 22 and 23, there is very little sliding movement between the butterfly plates 64 and 65 and the portion of the blank 20 with which the butterfly plates 64 and 65 are in contact. This minimizes scuffing of the outer surfaces of the package 10 by the butterfly plates 64 and 65.

During the closing of the pair of butterfly plates 65, the inside surface of the marginal portion of blank 20 which is laterally outward of the fold line 21 is folded longitudinally upon itself along the fold line 41 and outwardly along the fold line 21 to form a fin 76. The fin 76 extends outwardly through a vertical gap between the pair of butterfly plates 65, as shown in FIG. 8B. Similarly, the inside surface of the marginal portion of the blank 20 laterally outward of the fold line 24 is folded longitudinally along the fold line 42 and outwardly along the fold line 24, thus forming a fin 77. The fin 77 extends perpendicularly outwardly from the forming cavity 59 through a vertical gap between the pair of butterfly plates 64.

As indicated above, the longitudinal peripheral edges of the blank 20 are stepped inwardly along the fold line 28, such that the width of the blank 20, measured across the front panel 11 is greater than the width measured across the rear panel 12. Since the two portions of the blank 20 making up the fin 76 are both folded outwardly along the fold line 21, the front portion of the fin 76, formed from the front first side extension 13*a*, will be stick out farther from the side panel 13 than the rear portion formed from the rear first side extension 13*b*. Similarly, the front portion of the fin 77, formed from the front second side extension 14*a*, will stick out farther from the panel 14 that the rear portion formed from the rear second side extension 14*b*. The purpose for this disparity in length of the front and rear portions of each of the fins 76 and 77 will be discussed below. The cams 72 and 73 are mounted so as to be adjustable relative to the butterfly plates 64 and 65. The relative closing timing of the butterfly plates 64 and 65 can be adjusted by varying the distance a cam 72 or 73 has to travel to contact the associated butterfly plate plates 64 or 65. The relative closing timing of the butterfly plates 64 and 65 controls the alignment of the front and rear sealing portions of the fins 76 and 77.

An ultrasonic generator 78 is provided with an output horn 78*a*. The horn 78*a* and a cooperating anvil 79 are brought toward one another on either side of the fin 76, immediately outwardly of the butterfly plates 64, pinching the fin 76 therebetween. Similarly, a second ultrasonic generator 80 has a horn 80*a*. The horn 80*a* and a cooperating anvil 81 are brought together to pinch the fin 77 therebetween, preferably at essentially the same time that the horn 78*a* and the anvil 79 are squeezing the fin 76. The mechanism for moving the horns 78*a* and 80*a* and anvils 79 and 81 will be discussed below. Note that the butterfly plates 64 and 65 protect the surfaces of the blank 20 from scuffing as the horns 78*a* and 80*a* and anvils 79 and 81 are brought together. The horns 78*a* and 80*a* and anvils 79 and 81 only squeeze the fins 76 and 77, and do not rub against any portion of the blank 20, which is otherwise held out of the way of the horns 78*a* and 80*a* and anvils 79 and 81 by the butterfly plates 64 and 65. As discussed above, there is no substantial relative movement between the butterfly plates 64 and 65 and the adjacent faces of the blank 20, and hence no scuffing of the printed surfaces of the blank 20. In this manner, the appearance of the package 10 is protected during forming from the blank 20.

The horns 78*a* and 80*a* are preferably formed of titanium, while the anvils 79 and 81 are preferably formed of stainless steel. The anvils 79 and 81 are preferably formed with respective pluralities of slightly raised parallel ribs 79*a* and 81*a* which extend the length of the faces thereof which bear against the respective fins 76 and 77. Each of these pluralities of ribs 79*a* and 81*a* is pressed against the respective fin 76 and 77 along the length thereof. Note that the fins 76 and 77 should be flat between the horns 78*a* and 80*a* and anvils 79 and 81 so that the two layers of the blank 20 captured therebetween are each substantially wrinkle-free, for reasons which will be discussed below.

Figure 14:
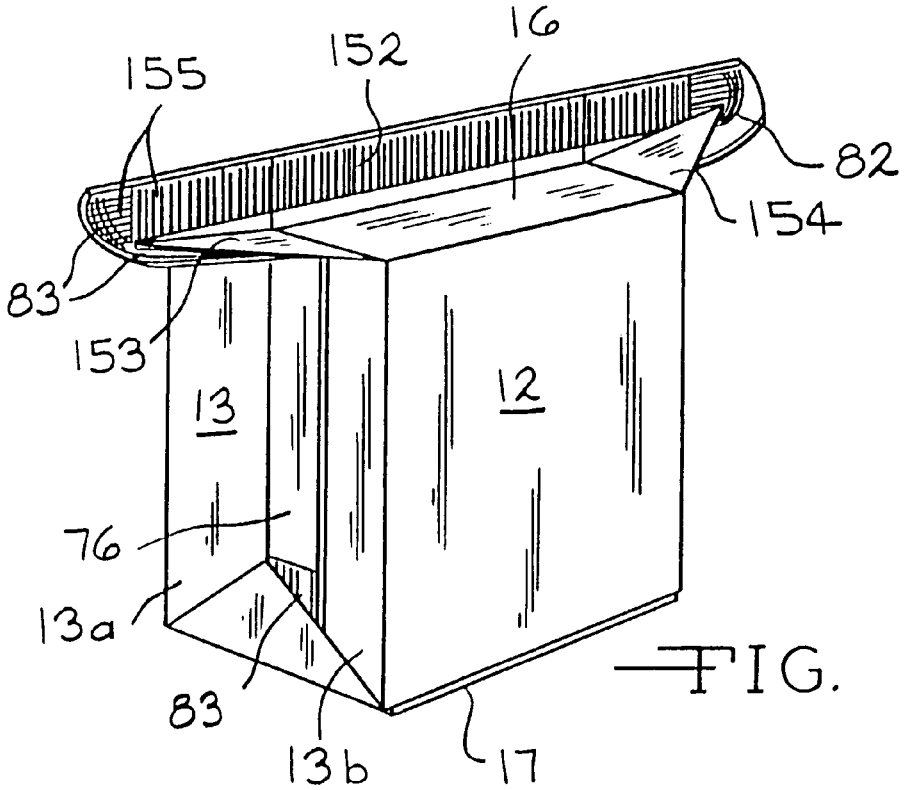
FIG. 14 is a view similar to FIG. 12 showing the package following ultrasonic sealing of the bottom fin seal and illustrating how the bottom fin seal overlaps the side fin seals to completely seal the package.

With the fins 76 and 77 thus firmly grasped between the respective pairs of horns and anvils, the ultrasonic generators 78 and 80 for the respective horns 78*a* and 80*a* are actuated briefly, causing the inner thermoplastic layers of the fins 76 and 77 to be melted and then fused together. This forms seals 82 and 83 (shown in hidden line in FIG. 9, and partially shown in FIGS. 12 and 14) on the rear side of the fins 76 and 77, respectively, adjacent the entire length of each rib of the associated anvil 79 and 81.

Referring again to FIG. 8A, the respective horn and anvil pairs 78*a* and 79, and 80*a* and 81 are then moved apart to the positions illustrated therein. Next, the pairs of butterfly plates 64 and 65 are returned to the open position. Springs (not shown) provide the move force for opening the pairs of butterfly plates 64 and 65.

A transfer device 84 having suction cups 85 with vacuum selectively supplied thereto reciprocates up into a recess 86 formed in the lower portion of the stationary surface 61. The recess 86 permits the transfer device 84 to move vertically along side of the blank 20. The transfer device 84 then moves horizontally against the blank 20, which is still positioned about the mandrel 66. The vacuum to the suction cup 67 is released, and vacuum applied to the suction cups 85 of the transfer device 84, grasping the blank 20. The transfer device 84 then reciprocates downwardly in the slot 86, and the blank 20 is removed through the bottom of the forming cavity 59 and transferred out of the forming station 58.

Referring again to FIG. 4A, the mechanism for moving the horns 78*a* and 80*a*, and the anvils 79 and 81 preferably includes a toggle linkage 87 which includes a lever 88, which is centrally pivoted about a fixed point 89. A spring assembly 90 pivotally connects a first end of the lever 88 to both of the anvils 79 and 81 (not shown). The spring assembly 90 preferably includes a central guide rod and an outer coil spring, which is pre-loaded by a nut threaded onto the central guide rod (not shown). The pre-load of the spring can be adjusted for different thickness of fins 76 and 77 among different types of blanks 20. Additionally, the use of the spring assembly 88 helps ensure that the sealing pressure exerted upon the fins 76 and 77 will remain relatively constant during the operation of the forming station 58. The sealing pressure will remain relatively constant even as the components of the forming station 58 thermally expand or contract slightly due to changes in temperature.

The second end of the lever 88 is connected by a link 91 to a reciprocative carriage 92 supporting both of the horns 78*a* and 80*a*, and the associated ultrasonic generators 78 and 80. The amplitude of motion of each horn 78*a* or 80*a* and the respective anvil 79 or 81 are equal when the length of the spring assembly 90 is equal to the length of the link 91. The power supplies (not shown) for the ultrasonic generators 78 and 80 are mounted separately therefrom, and are stationary. The power supplies are connected with the moveable ultrasonic generators 78 and 80 by flexible cabling. The second end of the lever 88 is also pivotally connected by a link 93 to an actuator 94. Preferably, the actuator 94 is a conventional rotary hydraulic actuator operating through ninety degrees, although those of ordinary skill in the art will recognize that other arrangements such as a hydraulic cylinder or electric motor may be used.

When the actuator 94 is operated to pull upwardly on the link 93, the linkage consisting of the lever 88, the link 92, and the spring assembly 90 operates to move the anvils 79 (and 81) rightwardly in FIG. 4A. The linkage also operates to move the carriage 92, together with the horns 78*a* (and 80*a*), leftwardly. The lever 88 is part of a toggle linkage. Characteristically, operation of the toggle linkage results in a high relative velocity between the horns 78*a* and 80*a* and the respective anvils 79 and 81 during much of the range of motion of the toggle linkage, with the relative velocity therebetween decreasing as the lever 88 approaches horizontal. Thus, as the fins 76 and 77 are grasped for sealing, the relatively velocity between the horns 78*a* and 80*a* and the respective anvils 79 and 81 is relatively small, minimizing vibration and shock to the forming station 58. The actuator 94 reverses direction of operation after the fins 76 and 77 are sealed, driving the link 93 downwardly. The lever 88 is rotated back out of horizontal, and the respective pairs of horns and anvils 78*a* and 79, and 80*a* and 81 are moved apart. Additionally, to ensure proper relative timing of the closing of the pairs of butterfly plates 64 and 65 by the respective pairs of cams 72 and 73, the operating mechanism (not shown) for the cams 72 and 73 is preferably mechanically linked to the actuator 92.

Referring to FIG. 4B, from the forming station 58, the blank 20 is transferred by mechanism 95 and a reciprocative lift member 96 to a fin and ear fold and seal station 100. The station 100 includes an indexing wheel 101. The indexing wheel 101 has a plurality of outwardly extending mandrels 102. The open packages 10 from the forming station 58 are mounted onto the indexing wheel 101 by placing the open mouths of each package 10 over successive ones of the mandrels 102, and pushing each package onto the respective mandrel 102 by the lift member 96.

Each package 10 is rotated to a pre-break position 103. As the package 10 is moved into the pre-break position 103, a pair of converging stationary guides 104 (only one guide 104 is shown in FIG. 4B) guides the package 10 into the pre-break position. As the indexing wheel 101 drives the package 10 between the guides 104, the guides 104 engage the fins 76 and 77. The guides 104 fold the fin 77 rearwardly against the first side panel 13. Similarly, the guides 104 fold the fin 76 rearwardly against the second side panel 14. The free longitudinal edges of the fins 76 and 77 thus extend rearwardly toward the back panel 12.

The station 100 also includes a pair of folding members 105 (only one of which is shown in FIG. 4B), which may be in the form of flat plates rotatable about respective longitudinal axes. The folding members 105 are operative in the pre-break position 103 to fold the triangular ears 74 and 75 outwardly while the uppermost portions of the exterior of the side panels 14 and 13 are supported by a pair of stationary members. The stationary members providing support may suitably be the stationary guides 104. The mandrel 102 provides support from the interior of the package 10 to prevent deforming the other portions of the package 10 during the outward folding of the ears 74 and 75. The mandrel 102 and the stationary members cooperate during the outward folding of the ears 74 and 75 to cause the pre-breaking to occur along the fold lines 27*a* and 28 adjacent to the ear 74, and along the fold lines 27*b* and 28 adjacent to the ear 75. Pre-breaking with the package 10 supported as described above helps ensure the ears 74 and 75 will fold smoothly along these fold lines during final folding and sealing. Thus the station 100 is operative in the pre-break position 103 to produce the package 10 as shown in FIG. 10.

The package 10 is then moved to a hearing position 106. In the heating position 106, the thermoplastic layer of the laterally outward surface of the ears 74 and 75, and the adjacent portions of the respective second and first side panels 14 and 13 are heated by a heater assembly 107, causing the thermoplastic to melt in these areas. The heater assembly 107 is preferably similar in design to the heater assemblies 39 and 54.

Figure 11:
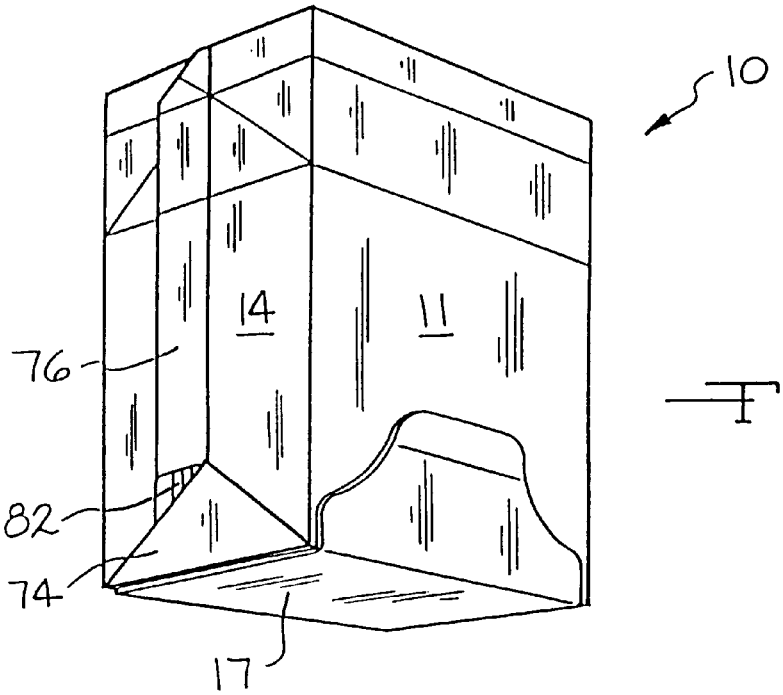
FIG. 11 is a view similar to FIG. 10 wherein the ear portions illustrated in FIG. 10 are sealed against the side panels.

The package 10 is then rotated to an ear fold position 108. The package is moved between a pair of guide and support members 109 (only one of which is illustrated in FIG. 4B) as the package 10 is rotated into the ear fold position 108. The guide and support members 109 provide an inwardly tapered opening into the ear fold position 108, in which the fins 76 and 77 are again pressed flat against the respective second and first side panels 14 and 13 as the package 10 is moved therebetween. Folding members 110, in the form of rotating flat plates (only one of which is shown in FIG. 4B), fold the ears 74 and 75 outwardly and against the respective side panels 14 and 13. The folding members 110 hold the ears 74 and 75 in position momentarily while the melted thermoplastic layers of the ears 74 and 75 fuse with the melted thermoplastic layers of the respective side panels 14 and 13, sealing the ears 74 and 75 in this folded position. Note that the guide and support members 109 cannot support the upper portions of the first and second side panels 13 and 14, sealing the ears 74 and 75 will be sealed to the upper portions of the first and second side panels 13 and 14. However, the ears 74 and 75 will fold easily along the associated fold lines 27*a*, 27*b*, and 28 because of the pre-breaking which occurred in the pre-break position 103. FIG. 11 is illustrative of the package 10 following folding and sealing of the ears 74 and 75.

From the station 100, the package 10 is transferred to a fill and seal station 120. Referring to FIG. 4B, the package 10 is moved through the various positions within the station 120 by an endless loop conveyor 121 having a plurality of carriers 122 mounted thereon. Each carrier 122 has four side walls for supporting the package 10 during transport and during various forming operations. The inner end 123 of each carrier 122 is partially closed, to support the package 10, but is provided with a central opening (not shown) through which various reciprocative members can be moved for purposes which will be discussed below.

The fill and seal station 120 includes a transfer mechanism 124 for loading each package 10 into one or the carriers 122. The package 10 should be loaded into the package carrier 122 with the tab 17 and the top panel 15 adjacent the inner end 123 of the package carrier 122. Thus the open end of the package 10 will be uppermost during transport through the station 120. Additionally, the package 10 will preferably be oriented with the fins 76 and 77 facing away from the direction of transport through the station 120. This helps prevent the fins 76 or 77 from catching on any part of the station 120, thus helping to prevent the fin 76 or 77 and the package 10 being torn or otherwise deformed.

In this embodiment, the package 10 is removed from the indexing wheel 101 when the package 10 is in a horizontal position with the front panel 11 facing downwardly. The package 10 is then loaded into a package carrier 122 when the package carrier 122 is in a horizontal position, with the front panel 11 facing upwardly. Thus the package 10 must be flipped 180 degrees about a horizontal axis. The transfer mechanism 124 includes a holder 125 having a generally H-shaped cross-section for flipping the package 10. The package 10 is loaded into the upper half of the holder 125, with the front panel 11 facing the central part of the H-shaped cross section of the holder 125. An inside lip (not shown) is formed at the end of each leg of the H-shaped cross section. The upper two lips engage the free edges of the fins 76 and 77 to retain the package 10 in the holder 125, as the holder 125 rotates with the package 10 about a longitudinal axis. Note that the fins 76 and 77 are held flat against the respective second and first side panels 14 and 13 only where the ears 74 and 75, respectively, are sealed to the sides of the package 10. Elsewhere, the free edges of the fins 76 and 77 tend to bow outwardly from the package 10. Thus the free edges of the fins 76 and 77 provide an accessible feature by which the holder 125 can support the package 10 during rotation thereof without fear of scuffing portions of the package 10 having printed or embossed materials thereon. Of course, other suitable arrangements for supporting the package 10 during rotation thereof will be apparent to those of ordinary skill in the art in light of this disclosure. For example, the fins 76 and 77 may not bow outwardly in a particular embodiment of this invention, due to the characteristics of the particular materials used to make the blank 20. One alternate way to handle the package 10 would be to rotate the package 10 while gripping the package 10 with suction cups to which a vacuum is selectively applied.

In this embodiment the transfer mechanism 124 is capable of periodically transferring packages 10 to one or more additional fill and seal stations (not shown) operating in parallel to the station 120. The assembly station 44, the forming station 58, and the wing and ear fold and seal station 100 may be operated to form packages 10 faster than the station 120 can fill the packages 10. Thus, packages 10 may be supplied to the transfer mechanism 124 faster than they can be processed by the station 120. The excess packages 10 may advantageously be transferred to a second package fill and seal station.

After being loaded into a carrier 122 of the conveyor 121, the package 10 is conveyed to a filling device 126. The filling device 126, a preferred embodiment of which is shown schematically in FIG. 4B, dispenses a preset portion of material into the package 10. The material may be a liquid, or a dry granular or pulverized material which can be poured into the open package 10. The material may also be a single solid block of material which can be inserted into the open package 10. Thus, those of ordinary skill in the art will recognize that the structure of the filling device 126 may differ from the example described below to account for differences in the physical characteristics of the material dispensed into the package 10. For the purposes of illustration, however, one means for filling the package 10 with a fluid will be described.

The filling device 126 includes a pump 127. The pump 127 includes a reciprocative piston 128 disposed in a cylinder 129. The pump 127 may be selectively connected via a three-way valve 130 and a flexible fluid conduit 131 to a reservoir 132 of the fluid. The pump 127 can also be selectively connected via the valve 130 to a dispensing spout 133. A second valve 134 is preferably disposed at the very end of the dispensing spout 133. The second valve 134 may be closed when not dispensing fluid from the dispensing spout 133 to prevent dripping residual fluid from the dispensing spout 133 when no package 10 is positioned below the dispensing spout 133.

The pump 127, the valve 130, and the dispensing spout 133 are preferably mounted upon a common pivotal frame. This arrangement permits the dispensing spout 133 to be moved from the operating position illustrated in solid line in FIG. 4B to a cleaning position shown in broken line in FIG. 4B. In the cleaning position, the dispensing spout 133 is disposed above a clean-out trough 135 next to the filling device 126. The clean-out trough 135 will typically be connected to a plant waste system (not shown), such as a waste water treatment system. Waste fluids which are flushed into the clean-out trough 135 will drain therefrom and are disposed of in the plant waste system.

In operation, the package 10 is positioned below the dispensing spout 133, and a lifting member 136 is moved upwardly through the opening in the inner end 123 of the package carrier 122. The package 10 is lifted until the dispensing spout 133 is positioned inside the package 10 and spaced slightly apart from the top panel 15 (which is near the bottom of the package 10 in this orientation). The piston 128 of the pump 127 is drawn upwardly in the cylinder 129, drawing a charge of fluid from the reservoir 131, through the fluid conduit 121 and the valve 130, and into the cylinder 129. The stroke of the piston 128 may be varied, using conventional methods, thereby permitting the amount of the charge of fluid to be dispensed into each package 10 to be varied. The valve 130 is repositioned, the second valve 134 opened, and the piston 128 driven downwardly to drive the charge of fluid out of the cylinder 129 and into the package 10. Preferably, when the package 10 is about half full, the lifting member 136 will be operated to slightly lower the package 10, thus allowing the package 10 to be filled without splashing or overflowing.

At times it may be desirable to purge the internal fluid carrying parts of the filling device 126 of the fluid being dispensed. For example, when changing fluids to be dispensed, it is normally necessary to flush any remaining fluid from the flexible fluid conduit 131, the valves 130 and 134, the pump 127 and the dispensing spout 133 prior to dispensing the new fluid into the package 10. This may be accomplished by disconnecting the flexible fluid conduit from the reservoir 132 and connecting the flexible fluid conduit 131 to a source of the new fluid. Alternatively, the fluid may be added to the reservoir 132 after draining the reservoir 132 of any remaining fluid from the previous batch of fluid. The frame carrying the dispensing spout 133 is tilted to the cleanout position thereof. The pump 127 and the valves 130 and 134 are operated to pump the new fluid through the fluid carrying parts of the filling device 126 and into the clean-out trough 135. When an examination of the fluid being pumped into the clean-out trough 135 indicates that the previously dispensed fluid has been sufficiently purged from the system, the frame carrying the dispensing spout 133 may be pivoted to move the dispensing spout 133 back to the normal operating position. The new fluid can then be dispensed into the package 10 as described above.

When the charge of fluid has been dispensed into the package 10, the second valve 134 shuts and the lifting member 136 retracts to allow the package 10 to be re-seated in the package carrier 122. A push-down device 137 may be operated to drive the package 10 down into the package carrier 122 if the weight of the package 10 with a charge of fluid therein is insufficient to overcome friction between the package 10 and the sidewalls of the package carrier 122. Such friction may result from the outward bowed fins 76 and 77 bearing against the adjacent side walls of the package carrier 122. The package 10 is then transferred by the conveyor 121 to a bottom sealing device 138.

Figure 13B:
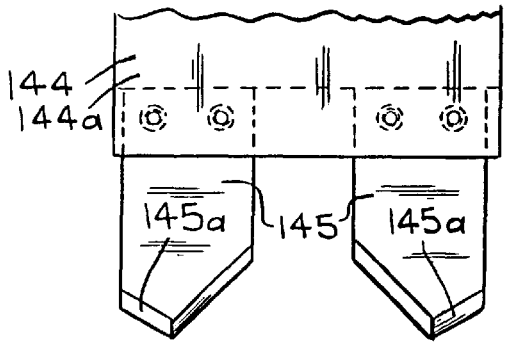
FIG. 13B is a view taken along the line 13B—13B of FIG. 13A, illustrating the fingers of the spreading member shown therein.
Figure 13A:
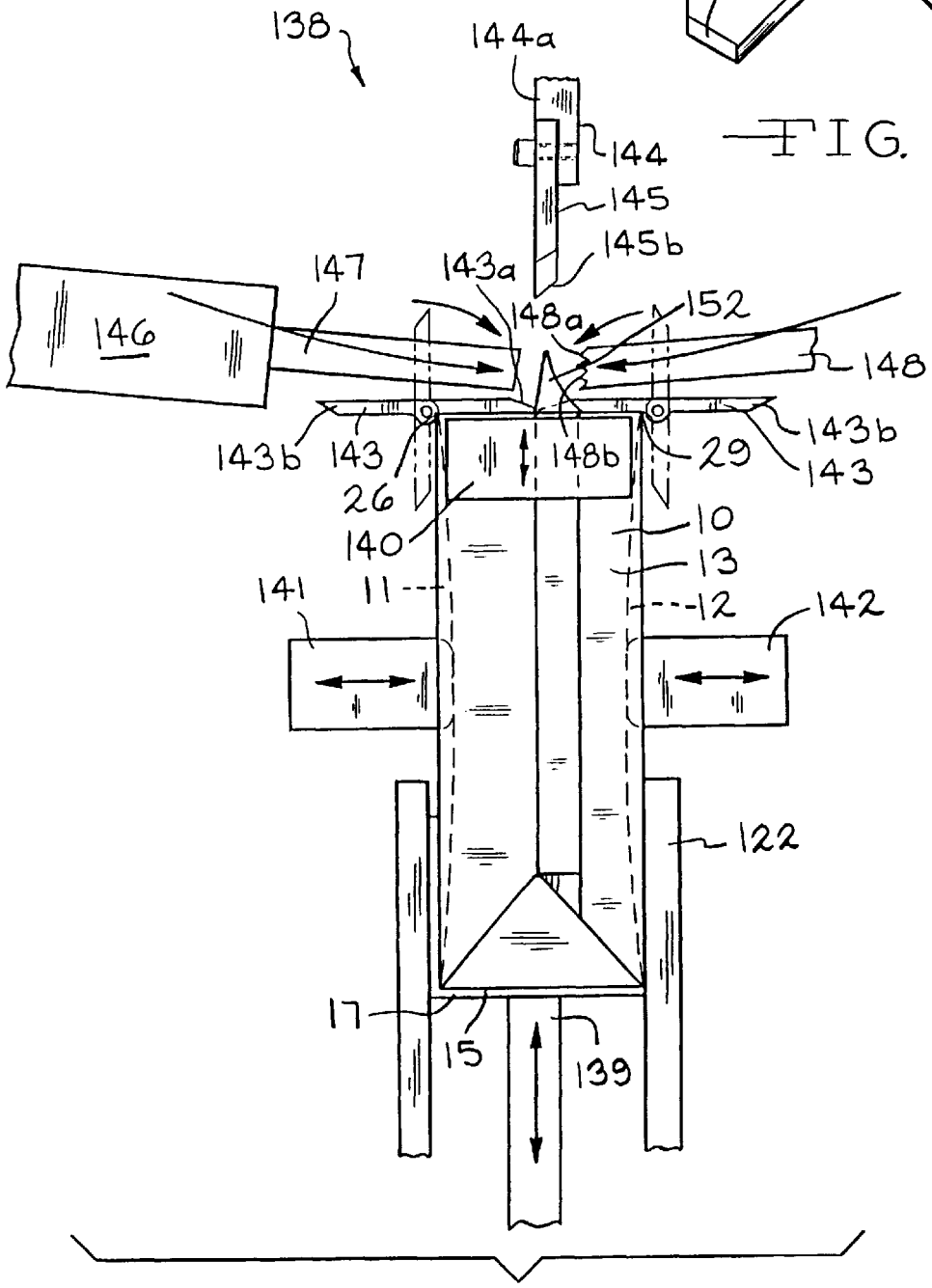
FIG. 13A is a side elevational view showing how the package is supported during the folding of the package in FIG. 12, followed by ultrasonic sealing to form a bottom fin seal.

Referring now to FIG. 13A, the bottom-sealing device 138 includes a second lifting member 139 adapted to lift the package 10 into a sealing position. The bottom-sealing device 138 also includes a pair of opposed side support members 140 (only one of which is shown) adapted to engage and support the side panels 13 and 14 when the package 10 is moved into the bottom sealing device 138. Preferably, the side support members 140 are relieved at the entry portion thereof to avoid catching on a portion of the package 10 as the package 10 is moved therebetween. A front moveable finger 141 and a rear moveable finger 142 are adapted to selectively push inwardly on, respectively, the front panel 11 and rear panel 12 of the package 10. A pair of butterfly plates 143 are disposed adjacent the package 10 in the sealing position. Each of the pair of butterfly plates 143 is selectively pivotal between a horizontal position and a vertical position, as indicated by the dashed line in FIG. 13A. Preferably, a portion 143*a* of the adjacent upper edges of each of the pair of butterfly plates 143 relieved for a purpose which will be discussed below. Additionally, tapered guide fingers 143*b* are formed on the portion of each of the pair of butterfly plates 143 which is lowermost when the butterfly plates 143 are in the vertical position. The two sets of guide fingers 143*b* (one set for each of the pair of butterfly plates 143) guide the package 10 therebetween when the package 10 is being lifted into the sealing position.

The bottom sealing device 138 also includes a spreading member 144. As best seen in FIG. 13B, the spreading member 144 includes a support bar 144*a* upon which are two adjustably mounted, downwardly extending fingers 145. The fingers 145 cooperate to define a pair of upwardly divergent outer faces 145*a*. The fingers 145 are adjusted such that the distance between the upper portions of the outer faces 145*a* is slightly greater than the width of the package 10 between the first and second side panels 13 and 14, the reason for which will be described below. Additionally, as shown in FIG. 13A, the rear face 145*b* of each of the fingers 145 is tapered downwardly toward the front face of the respective finger 145, for a purpose which will be described below.

The bottom sealing device 138 includes a sealing mechanism consisting of an ultrasonic generator 146 having a horn 147, and a cooperating anvil 148. The sealing face 148*a* of the anvil 148 is preferably generally rectangular; however, the lower left and right corners (not shown) of the sealing face 148*a* are rounded or relieved somewhat, for a purpose which will be discussed below. The anvil 148 is provided with a plurality of slightly raised ribs 148*b* similar to the ribs 79*a* and 81*a* of the anvils 79 and 81 of the forming station 58. The ribs 148*b* generally run vertically on the face 148*a*, however, near the longitudinal ends of the face 148*a*, the ribs 148*b* are horizontal.

The anvil 148 and the ultrasonic generator 146 are each mounted on a toggle linkage 149 for movement relative to the package 10 as shown in FIG. 4B. The toggle linkage 149 is generally similar to the toggle linkage 87 and includes a spring assembly 150, similar to the spring assembly 90. The toggle linkage 149 is selectively moved by a rotary actuator 151, similar to the actuator 94.

In operation, the package 10 is positioned below the bottom-sealing device 138, and the second lifting member 139 is operated to raise the package 10 to the sealing position. While the package 10 is being raised, one of the pair of side support members 140 is moved upwardly with the package 10, bearing against the upper portion of the first side panel 13, adjacent the fold lines 26 of the front first side extension 13*a* and the fold line 29 of the rear first side extension 13*b*. The other of the pair of side support members 140 is similarly moved upwardly with the package 10, bearing against the upper portion of the second side panel 14 adjacent the fold lines 26 and 29. This causes the fins 76 and 77 to be folded flat against the respective side panels 13 and 14.

As indicated above, the front portion of the fin 76 extended out further than the rear portion of the fin 76 prior to folding the fin 76. Thus, with the fin 76 folded rearwardly against the side panel 13, the outer surface of the front portion of the fin 76 will be all of the fin 76 which may be seen when looking at the side panel 13. In particular, the inner surface of the rear portion of the fin 76 will be covered completely by the front portion, and will not form a distracting vertical line in the middle of any printing which may be placed on the side panel 13. Similarly, the front portion of the fin 77 stuck out further from the panel 14 before the fin 77 was folded rearwardly against the panel 14, and thus will completely cover the rear portion of the fin 77 after folding. Preferably, the width of the blank 20 across the front panel 11 will be sufficiently greater than the width of the blank 20 across the rear panel 12 that the inner surface of the rear portion of the fins 76 and 77 will not be exposed, even with maximum expected misalignment of the blank 20 present during formation of the fins 76 and 77. Thus the outer portion of each of the fins 76 and 77 will completely cover the adjacent outer surface of the associated inner portion of the fins 76 and 77.

As the package 10 is raised to the sealing position, the depending fingers 145 of the spreading member 144 engage the interior surfaces of the sides of the open end of the package 10. The spreading member 144 thus cooperates with the pair of side support members 140 to bend the package 10 slightly outwardly along the portions of the fold lines 26 and 29 above the first and second side panels 13 and 14.

Figure 12:
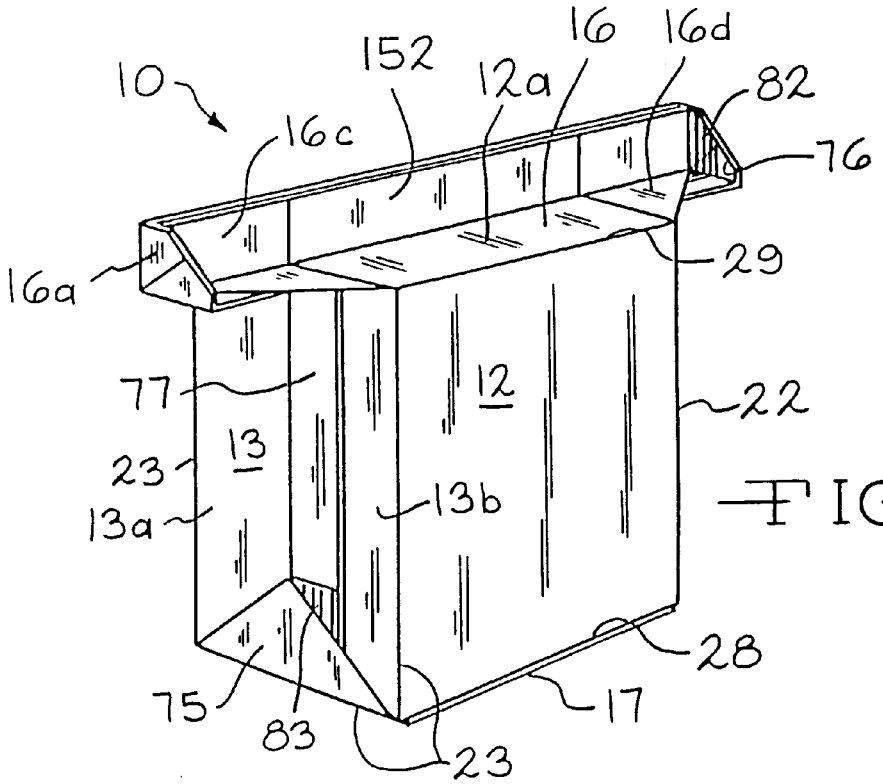
FIG. 12 is a top perspective view which illustrates a fabrication step following filling of the package in which the bottom fold lines of the package are folded to prepare a sealing surface across the bottom panel of the package.

As indicated above, the package 10 is guided between the guide fingers 143*b* on each of the butterfly plates 143 as the package 10 is raised. With the package 10 is fully raised to the sealing position, and the sides of the package 10 slightly bowed outwardly, the pair of butterfly plates 143 are rotated to their horizontal position. Rotation of the pair of butterfly plates 143 causes the package 10 to fold along the fold lines 25 and 26, and along the fold lines 29 and 30 as shown in FIGS. 12 and 13A. The inner surfaces of the portion of the blank 20 longitudinally outward of the fold line 25 and of the portion of the blank 20 longitudinally outward of the fold line 30 are brought together to form a fin 152.

Additionally, as the pair of butterfly plates 143 are rotating from vertical to horizontal, the first and third bottom panel extensions 16*a* and 16*c* are folded over the top of the adjacent side support member 140 to form a horizontal outwardly extending ear 153. The second and fourth bottom panel extension 16*b* and 16*d* are similarly folded the other side support member 140 to form another horizontal outwardly extending ear 154. The marginal portions of the first and second bottom panel extensions 16*a* and 16*b*, longitudinally outward of the fold line 25, and the marginal portions of the third and forth bottom panel extension 16*c* and 16*d*, longitudinally outward of the fold line 30, form portions of the fin 152. The fin 152 extends perpendicularly from the bottom panel 16, and extends outwardly between the adjacent edges of the pair of butterfly plates 143, as shown in FIG. 13A.

Just before the pair of butterfly plates 143 are fully horizontal, the front and rear moveable fingers 141 and 142 are brought relatively closer together, squeezing the package 10 to remove excess air therefrom. The air escapes out through the opening between the front bottom extension 11*a* and the rear bottom extension 12*a* before the fin 152 is sealed.

Next the rotary actuator 151 (FIG. 4B)is operated to actuate the toggle linkage 149, moving the horn 147 and the anvil 148 arcuately into contact with the fin 154. The relieved portion 143*a* on the upper surface of each of the pair of butterfly plates 143 allow the horn 147 and the anvil 148 to contact the fin 152 close to the fold lines 25 and 30, respectively. The toggle linkage 149 presses the horn 147 and the anvil 148 against respective sides of the fin 152. The relieved lower corners of the anvil 148 cooperate with the trihedral corners 20*f*, 20*g*, 20*h*, and 20*i* of the blank 20 to urge the marginal portions of the fin 152 outward of the fold lines 21 and 24 to fold outwardly and lay flat between the anvil 148 and horn 147. As with the toggle linkage 87 and the spring assembly 90, the spring assembly 150 regulates the pressure exerted by the toggle linkage 149 upon the fin 152. The sealing face 148*a* of the anvil 148 and the corresponding face of the horn 147 contact the fin 152 along almost the entire length thereof, extending beyond the fold lines 21 and 24 to contact the sealed fins 76 and 77.

The ultrasonic generator 146 is energized, heating the fin 152 between the horn 147 and the anvil 148. Note that the ribs 148*b* are spaced sufficiently close together that the thermoplastic layer will melt between the ribs 148*b* as well as the portion of the layer in contact with the ribs 148*b*. When the generator 146 is deenergized and the fin 152 cools, a continuous seal will be formed along the fin 152 extending between the fins 76 and 77. This produces the sealed parallelepiped package 10 shown in FIG. 14. A seal 155 will be formed where the ribs 148 contacted the surface of the fin 152. The seal 155 produced by the horn 147 and the anvil 148 overlaps the seals 82 and 83 produced by the horns 78*a* and 80*a* and the respective anvils 79 and 81. This helps ensure leak-tight sealing of the package 10. It should be noted that it is important that the fin 152 be relatively wrinkle-free between the horn 147 and the anvil 148 during ultrasonic heating. Wrinkles cause uneven thickness and pressures along the fin 152 which can result in burning of the paperboard material of the package 10. Note that it is important to prevent wrinkling of the side fins 76 and 77 for the same reasons.

Several aspects of this invention are directed to preventing wrinkling of the fin 152 in the sealing area in contact with the horn 147 and anvil 148. These include the relieved lower corners of the anvil 148, which prevent concentrating stresses in the fins 76 and 77 as the fins 76 and 77 pass over the corners. Thus, the fins 76 and 77 lie smoothly on the relieved corners and on the sealing face 148*a* of the anvil 148.

Furthermore, the trihedral, "clipped" shape of the four corners 20*f*, 20*g*, 20*h*, and 20*i* of the blank 20 allow the fins 76 and 77 to be under relatively low stress as the fins 76 and 77 are bent around the respective relieved lower corners of the anvil 148 and under the respective horizontally extending ears 154 and 153. Since the fins 76 and 77 are relatively unstressed, no wrinkles will be formed in the portions of the fins 76 and 77 which are in contact with the sealing face 148*a* of the anvil 148.

Finally, the horn 147 and the anvil 148 preferably do not hold the fin 152 perpendicular to the bottom panel 16, but rather hold the fin 152 at a small angle to the perpendicular. Suitably, the horn 147 and the anvil 148 will hold the fin 152 at about a 75 degree angle from the bottom panel 16 in the direction of the rear panel 12. This further helps prevent the formation of wrinkles in the fin 152 between the horn 147 and the anvil 148 and relieve stresses in the fins 76 and 77. Furthermore, as will be seen below, holding the fin 152 at an acute angle to the panel 16 also predisposes the fin 152 to fold in the direction of the angle.

After the fin 152 is sealed, the toggle linkage 149 is operated to retract the ultrasonic generator 146 with its horn 147, and the anvil 148. The front and rear moveable fingers 142 and 143 are retracted away from the package 10. The second lifting member 139 retracts to allow the package 10 to move downwardly, along with the side support members 140 until the side support members 140 are aligned with a pair of horizontally extending rails 156. The side support members 140 cooperate to support the package 10 by the ears 153 and 154 thereof in an intermediate lift position as the second lifting member 139 is retracted out of the package carrier 122.

The spreading member 144 is then moved downwardly. The fingers 145 of the spreading member will push the package 10 downwardly to the intermediate lift position if the weight of the package 10 is insufficient to cause the package 10 to slide downwardly in the package carrier 122 and cause the ears 153 and 154 to contact the side support members 140. Note that, as indicated above, the rear face 145*b* of each of the fingers 145 is tapered downwardly toward the front face of the respective finger 145. In combination with sealing the fin 152 at a rearwardly leaning angle, the taper on the rear face 145*b* of the fingers 145 ensures that when the fingers 145 contact the fin 152, the fin 152 will not be crushed or bent forwardly, but will rather be folded toward the back panel 12.

Figure 16:
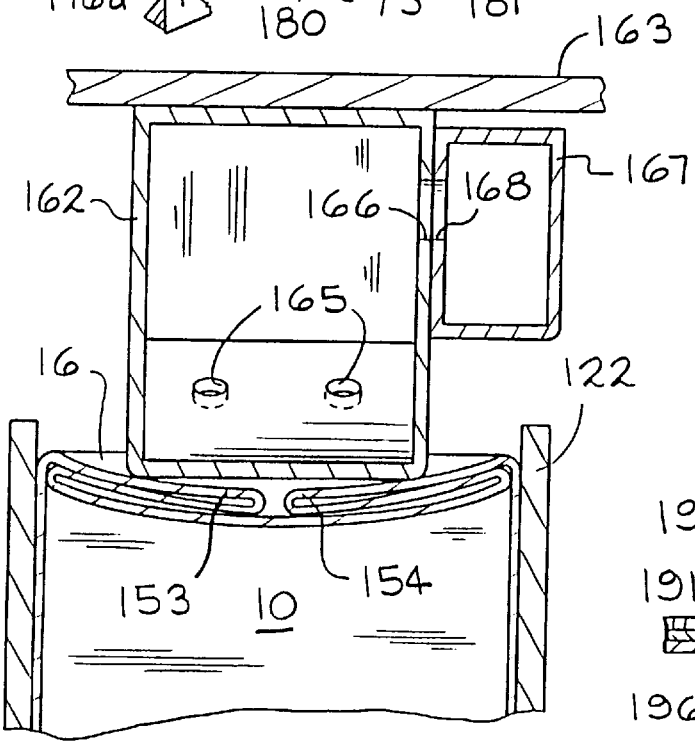
FIG. 16 is a sectional view of the package wherein the bottom ears are being held in place and air cooled following the final forming step.

Referring now to FIGS. 4B, 15 and 16, while the package 10 remains in the intermediate lift position, the package carrier 122 moves the package 10 off the side support members 140, and onto the pair of rails 156 for movement to a seal fold-down mechanism 157. The side support members 140 are then fully retracted to receive the next package 10 to be moved into the bottom sealing device 138. The package 10 is supported in the intermediate lift position by the horizontally extending ears 153 and 154, which slide upon respective ones of the rails 156. The seal fold-down mechanism 157 is operable to fold the fin 152 rearwardly against the bottom panel 16. The package 10 is then advanced to an ear erector mechanism 158. A reciprocative member of the ear erector mechanism 158 bears against the top of the package 10 to force the package 10 downwardly in the package carrier 122. As the package 10 moves downwardly, the ears 153 and 154 are bent upwardly by respective ones of the rails 156.

The package 10 is advanced to a final heater assembly 159, which is preferably generally similar in construction to the heater assemblies 48, 54, and 107 described above. The heater assembly 159 heats the bottom panel 16 and the opposing inner faces of the ears 153 and 154 to melt the thermoplastic layers thereon.

The package 10 is then advanced toward an ear compressor 160. Reciprocative folding members 161 (only one of which is shown in FIG. 4B) are positioned at the entrance to the ear compressor 160. The folding members 161 are moved to bear against respective ones of the ears 153 and 154 to fold the ears 153 and 154 inwardly toward one another as the package 10 is moved between the folding members 161, as shown in FIG. 15.

The ear compressor 160 includes a plurality of compressing members 162 mounted on an endless loop conveyor 163. As shown in FIG. 4A, each compressing member 162 has a bifurcated bearing surface 164. Preferably, the compressing members 162 are hollow and are provided with a plurality of outlet holes 165, and a single inlet hole 166 (FIG. 16). The compression members 162 which are on that portion of path of travel of the conveyor 163 which immediately above a corresponding package carrier 122 are in sliding contact with an adjacent air supply header 167. The air supply header 167 is selectively supplied with compressed air, typically from the same source of pressurized air 49 which is selectively supplied to the heater assemblies 48, 54, 107, and 159. A plurality of air outlet holes 168 are formed in the air supply header 167, the purpose of which will be discussed below.

The movement of the conveyor 163 is synchronized with the movement of the conveyor 121 to position one of the compressing members 162 above each of the package carriers 122. While the folding members 161 are urging the ears 153 and 154 inwardly, a compressing member 162 travels about one end of the conveyor 163 and moves downwardly to bear against both of the ears 153 and 154. As the package 10 is moving out from between the folding members 161, the compressing member 162 folds the ears 153 and 154 against the bottom panel 16, depressing the bottom panel 16 inwardly into the package 10, as best seen in FIG. 16. As the heated thermoplastic surfaces of the package 10 cool and solidify, the ears 153 and 154 will be sealed to the bottom panel 16. Additionally, the ears 153 and 154 will act to hold the bottom panel 16 bowed inwardly, providing a recess within which the ears 153 and 154 are contained. This will allow the package 10 be placed on a flat surface, such as a table top, and rest stably rest along the fold 26 and 29 and not be supported on the ears 153 and 154.

As the compressing members 162 are advanced with the packages 10 in the package carriers 122, periodically the inlet holes 166 of the compressing members 162 will be aligned with the air outlet holes 168 in the air supply header 167. Compressed air is then supplied to the air header 167, which travels through the air outlet holes 168 and into the adjacent compressing members 162 through the inlet holes 166 thereof. The compressed air then is directed through the outlet holes 165 onto the bottom panel 16 and ears 153 and 154 of the package 10, cooling the surfaces thereof to speed the sealing of the ears 153 and 154 against the bottom panel 16. This air cooling speeds the sealing of the ears 153 and 154 to the bottom panel, allowing the compressing member 162 to be removed therefrom relatively quickly. However, it will be recognized that the compressing member 162 may be left in contact with the ears 153 and 154 for a longer period of time, for example by slowing the speed of the conveyors 121 and 163, or extending the length thereof. Following sealing of the ears 153 and 154 to the bottom panel 16, the package 10, as shown in FIGS. 1 and 15, is complete.

The package 10 is then advanced to an ejector station 169. The ejector station 169 includes a reciprocative member 170, which is advanced through the opening in the inner end 123 of the package carrier 122 to eject the package 10 from the package carrier 122. Typically, the package 10 will be ejected onto a suitable transfer conveyor (not shown) for transport to a cartoner (not shown).

Figure 17:
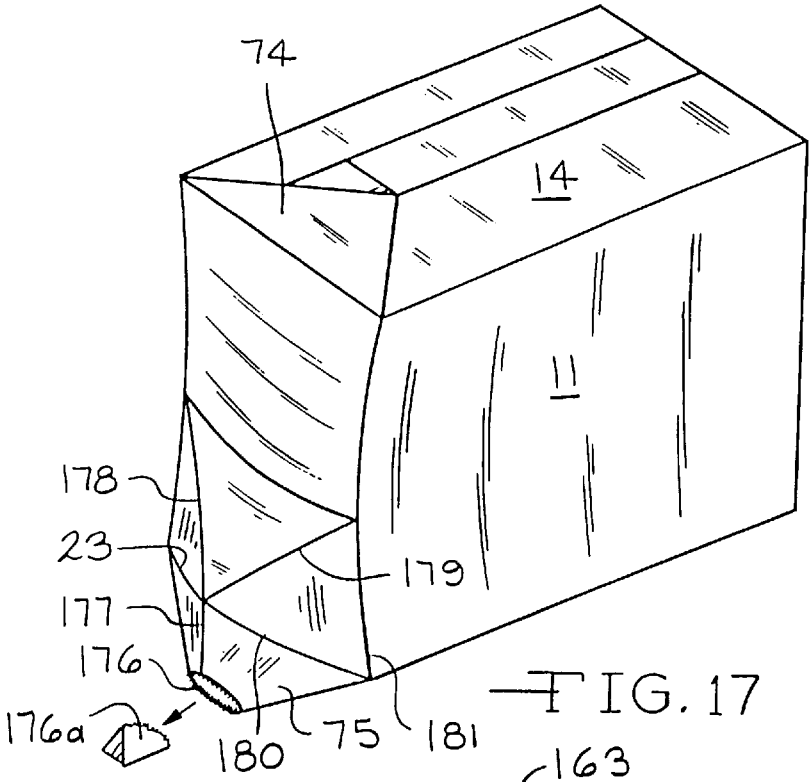
FIG. 17 is a perspective view of an embodiment of a package formed from a blank according to the invention having a paperboard pouring spout formed integrally with the package.

A second embodiment of a package of this invention is shown generally at 175 in FIG. 17. The package 175 is generally similar to the package 10 described above, and in the following discussion the same reference numbers will be used to describe features which are similar in structure and function. The package 175 is formed from a blank similar to the blank 20 described above, except that no opening 19 is provided, and thus no tab 17 is required. Instead, the blank is perforated such that the upper ear 74 can be pulled free from the side of the package 175, bent upwardly, and the tip portion thereof torn off along the perforations to form an opening 176 as shown. Thus, the perforations form a tear line defining a removable closure member 176*a*. The perforations may be formed in the paper core of the blank prior to applying inner and outer coatings thereto in order to preserve the leak-tightness of the package 175. Additional fold lines shown at 177, 178, 179, and 180 may be provided to allow the package 175 to be easily deformed to fully open the opening 176 of the package 175 for pouring out the contents thereof. Finally a fold line 181 is formed between the front panel 11 and the top panel 15 to facilitate forming a straight edge therebetween. It will be appreciated by those of ordinary skill in the art that the perforations defining the removable closure member 176*a* may be formed through any suitable portion of the blank. For example, a removable closure member may be defined in the upper portion of the front panel 11, and separated from the package 175 by pressing the closure member inwardly into the package 175 to break the webs between the perforations.

Figure 18:
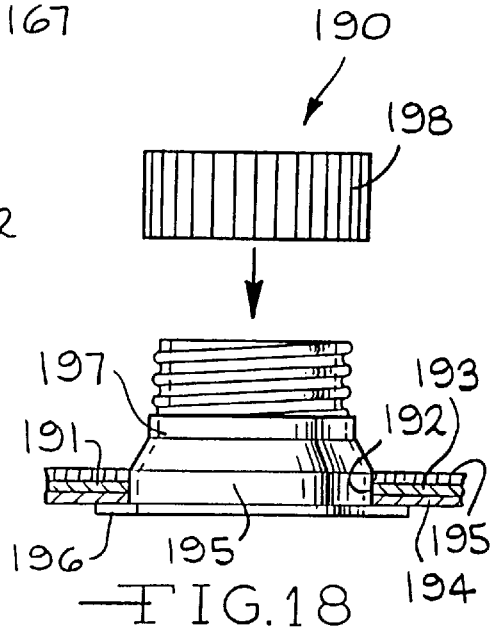
FIG. 18 is a partial side elevational view, partly in section, illustrating an embodiment of a package formed from a blank according to the invention having a screw-on resealable closure.

A third embodiment of a package of this invention is shown generally at 190 in FIG. 18. The package 190 is generally similar to the package 10 described above, and in the following discussion the same reference numbers will be used to describe features which are similar in structure and function. The package 190 is formed from a blank 191 similar to the blank 20 described above, except that instead of the opening 19, a circular opening 192 is formed through the upper panel 15. As with the blank 20 described above, the blank 191 is formed from a paper core 193, an inner coating 194 and an outer coating 195. In this embodiment the inner coating 194 is a thermoplastic material such as polyester or polyethylene.

The package 190 further differs from the package 10 in that no tab 17 is provided. Instead a tubular insert 195 is inserted through the opening 192. The insert 195 may be formed of any suitable material, such as a polymeric material like polyethylene, or a polyester. However, the material of the insert 195 preferably will be the same (e.g., polyester) as the material of the inner coating 124 to permit the insert 195 to be heat bonded to the inner coating 12. The insert 195 is provided with a circumferential flange 196 which engages the inner surface 194 of the package 190. The use of polyesters or other polymeric materials which have a relatively high melting point (in excess of about 120 degrees Celsius (about 250 degrees Fahrenheit)), rather than a polyethylene or other material which has a relatively low melting point (less than 120 degrees Celsius) is advantageous when the package 190 contains certain types of materials. For example, since the package 190 may be constructed without using metal components, if the package 190 contained frozen soups or drinks, which have a high water content, the package 190 and the contents thereof can be placed in a microwave oven and the contents thawed and heated to a desired serving temperature in the package 190 without the package 190 melting the plastic lining and losing structural integrity. Also such a package 190 may be hot filled to increase sterility and lengthen the shelf life of edible contents of the package 190.

The insert 195 further includes a threaded neck portion 197 which extends through the opening 192. A cap 198 is provided which can be threaded onto the neck portion 197 to seal the opening through the insert 195. The flange 196 of the insert 195 is circumferentially sealed to the inner surface 194 of the blank 191, preferably ultrasonically. Those of ordinary skill in the art will recognize that the insert 195 may be fixed to the blank 192 at any point in the forming process before the bottom panel 16 is formed and sealed. As can be clearly seen in FIG. 18, the cap 198 forms an external portion of the insert 195 which has a maximum diameter which is less than the diameter of the opening 192. Similarly, the neck portion 197 defines a maximum diameter which is less than the diameter of the opening 192. Thus, the external portion and neck portion 197 may be inserted through the opening 192 with the cap 198 preinstalled on the threaded neck portion 197. This will facilitate assembly operations. Additionally, it will be recognized that the bottom panel 16 may be formed and sealed prior to filling the package 190, if the package 190 is subsequently filled through the insert 195, which may then be sealed with the cap 198.

It will be appreciated that the total amount of plastic which is utilized in the package 190 to line both sides of the paperboard blank 191 and to form the insert 195 may be a relatively small portion of the total material used in the package 190. The paper core 193, which provides the structural rigidity of the package 190, forms the bulk of material used in the package, and is biodegradable. Thus, after the package 190 is empty and becomes waste material, the amount of plastic which needs to be disposed of is greatly reduced, compared to, for example, an all plastic bottle.

Figure 19:
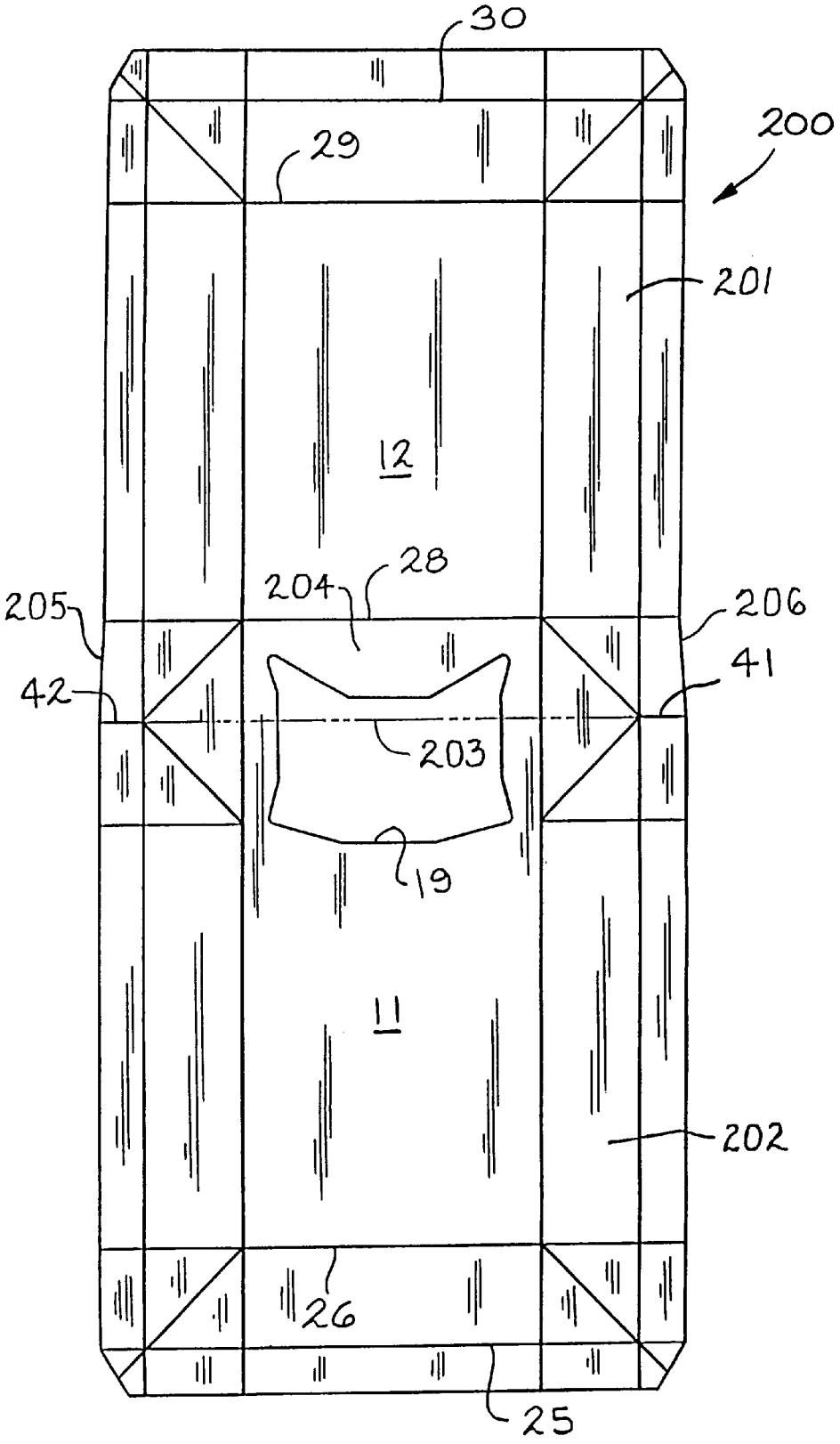
FIG. 19 is a view similar to FIG. 3A, illustrating a blank according to the invention having a pair of inwardly tapered portions on each longitudinal marginal edge.

FIG. 19 illustrates a fourth embodiment of the invention. A blank 200 is provided which is structurally similar to the blank 20 illustrated in FIGS. 3A and 6, and the same reference numbers will be used to refer to similar features. The blank 200 uses a somewhat different arrangement to vary the width of the blank 200 along the length thereof than the arrangement of the blank 20. As discussed above, the peripheral edges of the blank 20 are stepped inwardly along the fold line 28. In contrast, the peripheral edges of the blank 20 are slightly tapered toward one another from the fold line 41 to the fold line 28 and from the fold line 42 to the fold line 28.

Thus the blank 200 includes a generally rectangular first portion 201, which includes the rear panel 12 and has a boundary along the fold line 28. The blank 200 also includes a generally rectangular second portion 202, which includes the front panel 11 and has a boundary 203. The boundary 203 is defined as including the fold lines 41 and 42 and extending linearly therebetween, although the boundary 203 is not a scored fold line between the fold lines 41 and 42. A trapezoidal portion 204 of the blank 200 is interposed between the first portion 201 and the second portion 202. The trapezoidal portion 204 is joined to the first portion 201 along the fold line 28. The trapezoidal portion 204 is joined to the second portion 202 along the boundary 203. The trapezoidal portion 204 cooperates with the first portion 201 and the second portion 202 to define a pair of peripheral edges 205 and 206 of the blank 200 that are each inwardly tapered along the trapezoidal portion 204 from the second portion 202 toward the first portion 201. Thus each of the fold lines 25 and 26 are slightly longer than any of the fold lines 28, 29 and 30, and the width across the front panel 11 is greater than the width across the rear panel 12.

As with the blank 20, the purpose in varying the width of the blank 200 along the length thereof is to ensure that the outer printed portion of the blank 200 covers the inner unprinted portions of the blank 200 after the blank 200 is formed into a package and the side fins 76 and 77 thereof are folded flat against the sides thereof. Those of ordinary skill in the art will recognize, however, that the blank of this invention may be formed of equal width along the longitudinal edges 205 and 206 if desired.

While the package of the present invention has been illustrated and described as having specific unique opening top, side panel and bottom panel constructions, it will be appreciated that these particular unique features can be used either individually or in combination as described above.

Also, while the package is described and claimed herein as being generally rectangular or parallelepiped, it will be appreciated, that in some instances, it may be desirable to attach a handle or spout to the package either during or subsequent to the construction of the package.

It will be understood that the present invention may be practiced otherwise than as specifically explained and illustrated. For example, the packages of this invention may be provided with openings in other than the top panel thereof. Additionally, while this invention has been generally described as a paperboard laminate, it is contemplated that the package of this invention may be formed from flexible packaging sheet material formed from any of a variety of thermoplastic materials laminated to non-thermoplastic materials other than paper, and the blanks may be entirely paper free. Indeed, it is contemplated that the blanks of this invention may be formed entirely of thermoplastic materials. Thus, it will be appreciated that various modifications and changes may be made to the above described preferred embodiment of the invention without departing from the spirit or scope of the following claims.

What is claimed is:

1. A package comprising:

a front panel, a rear panel opposing said front panel, a first side panel joining said front panel to said rear panel, said first side panel comprising two portions joined by a first fin seal;

a second side panel opposed to said first side panel and joining said front panel to said rear panel, said second side panel comprising two portions joined by a second fin seal; and a bottom panel joining said front panel, said rear panel, said first side panel, and said second side panel, said bottom panel comprising two portions joined by a third fin seal, said third fin seal overlapping said first fin seal and folded to form a first ear having a truncated tip with a first trihedral corner, said third fin seal overlapping said second fin seal and forming a second ear having a truncated tip with a second trihedral corner.

2. The package of claim 1 wherein at least one of said first ear and said second ear is provided with a tear line to permit a portion of said at least one of said first ear and said second ear to be relatively easily torn off to form an opening into the package.

3. A blank of flexible packaging sheet material for constructing a container comprising:

a generally rectangular sheet of flexible packaging sheet material defining four corners;

at least four spaced apart longitudinal fold lines scored into said sheet;

at least four spaced apart transverse fold lines scored into said sheet; and four corner fold lines scored into said sheet, each corner fold line extending diagonally from an associated one of said corners of said sheet through the intersection of the transverse fold line most adjacent to the associated corner and the longitudinal fold line most adjacent to the associated corner to the intersection of the transverse fold line next most adjacent to the associated corner and the longitudinal fold line next most adjacent to the associated corner, wherein each of said corners of said sheet is trihedral.

4. The blank of claim 3 wherein said sheet includes a series of perforations forming a tear line defining a removable closure member.

5. The blank of claim 3 wherein one pair of longitudinally opposed ones of said corners are provided with mating tear lines.

6. The blank of claim 5 wherein said blank has a paper core, said paper core being perforated along said tear lines; said perforations being sealed on at least one side of said paper core so as to be leak-tight.

7. A blank of flexible packaging sheet material for constructing a container comprising:

a generally rectangular sheet of flexible packaging sheet material;

at least four spaced apart longitudinal fold lines scored into said sheet;

at least four spaced apart transverse fold lines scored into said sheet; and an opening defined through said sheet, said opening having an outwardly bowed first edge, said opening having a second edge defined by a first inwardly extending tongue portion, said first tongue portion defining a first width, a third edge defined by a second inwardly extending tongue portion, and a fourth edge defined by a third tongue portion extending inwardly between said first and second tongue portions, said third tongue portion defining a length less than one third of said first width.

8. A blank of flexible packaging sheet material for constructing a container comprising:

a sheet of flexible packaging sheet material having a generally rectangular first portion and a generally rectangular second portion spaced apart from said first portion;

at least four spaced apart longitudinal fold lines scored into said sheet, each of said longitudinal fold lines extending across both said first portion and said second portion;

a first pair of spaced apart transverse fold lines scored into said first portion of said sheet; and a second pair of spaced apart transverse fold lines scored into said second portion of said sheet, a trapezoidal portion of said sheet interposed between said first portion and said second portion, said trapezoidal portion being joined to said first portion along a first boundary, said trapezoidal portion being joined to said second portion along a second boundary, said trapezoidal portion cooperating with said first portion and said second portion to define a pair of peripheral edges of said sheet which are each inwardly tapered along said trapezoidal portion from said second portion toward said first portion such that each of said second pair of transverse fold lines is longer than either of said first pair of transverse fold lines.

9. A package having a first fin seal, a second fin seal spaced apart from said first fin seal, and a third fin seal overlapping said first and second fin seals, said package further having a front panel, a second panel extending at an angle to said front panel and cooperating with said front panel to define an opening therethrough, and a tab having a first portion removably fixed to said front panel, a second portion hingedly connected to said first portion and removably fixed to said second panel, and a grip portion hingedly connected to said first portion, said first portion and said second portion forming a leak tight seal over said opening.

10. A package comprising:

a front panel;

a rear panel opposing said front panel;

a first side panel joining said front panel to said rear panel, said first side panel comprising two portions joined by a first fin seal;

a second side panel opposed to said first side panel and joining said front panel to said rear panel, said second side panel comprising two portions joined by a second fin seal;

a bottom panel joining said front panel, said rear panel, said first side panel, and said second side panels, said bottom panel comprising two portions joined by a third fin seal, said third fin seal overlapping said first and second fin seals;

a top panel opposed to said bottom panel and joining said front panel, said rear panel, said first side panel, said second side panel, said top panel cooperating with said front panel, said rear panel, said first side panel, said second side panel and said bottom panel to define an interior surface of said package which encloses an internal volume of said package; and a plastic insert having an external portion disposed outside of said internal volume defined by said interior surface, said external portion defining a first maximum diameter, said insert further having a neck portion defining a second maximum diameter and extending through an opening defined in a selected one of said front panel, said rear panel, said first side panel, said second side panel, said bottom panel, and said top panel, said opening having a diameter greater than said first and second maximum diameters, said insert further having a flange portion sealed to said interior surface of said package about said opening.

11. The package of claim 10 wherein said plastic insert defines an opening therethrough, said neck portion defining an outer surfaces, a portion of said outer surface of said neck portion being threaded, said external portion of said insert including a cap removably threaded on to said neck portion to selectively seal said opening through said plastic insert.

12. The package of claim 10 wherein said flange portion of said plastic insert is heat bonded to a portion of said interior surface of said package.

* * * * *